United States Patent [19]

Oldroyd et al.

[11] Patent Number: 4,581,794

[45] Date of Patent: Apr. 15, 1986

[54] AUTOMATIC SEAMING MACHINE FOR FABRIC BELTS

[75] Inventors: Malcolm Oldroyd, Appleton; Dominique G. Rateau, Weyauwega; Merlin A. Luebke; Larry D. Anderson, both of Appleton, all of Wis.

[73] Assignee: Asten Group Inc., Devon, Pa.

[21] Appl. No.: 770,352

[22] Filed: Aug. 27, 1985

Related U.S. Application Data

[63] Continuation of Ser. No. 587,045, Mar. 7, 1984, abandoned.

[51] Int. Cl.[4] ..... D03J 1/14

[52] U.S. Cl. ..... 28/141

[58] Field of Search ..... 28/141; 139/1 R, 11 R, 139/28, 93

[56] References Cited

U.S. PATENT DOCUMENTS

| | | | |
|---|---|---|---|
| 1,341,244 | 5/1920 | Ruegg | 139/93 |
| 2,385,703 | 9/1945 | Heiber . | |
| 2,786,256 | 3/1957 | Axelsson . | |
| 2,845,686 | 8/1958 | Mason . | |
| 3,885,596 | 5/1975 | Alexeff . | |
| 3,962,762 | 6/1976 | Alexeff . | |
| 4,410,015 | 10/1983 | Koller et al. | 28/241 |

FOREIGN PATENT DOCUMENTS 3025909 2/1982 Fed. Rep. of Germany .

OTHER PUBLICATIONS

Publication by Samuel Dracup and Sons Ltd. Lane Close Mills, Great Horton.

*Primary Examiner*—Henry S. Jaudon

[57] ABSTRACT

A machine for forming a seam in a length of woven fabric to join together opposite ends of the gavric to thereby form an endless woven fabric belt.

41 Claims, 14 Drawing Figures

AUTOMATIC SEAMING MACHINE FOR FABRIC BELTS

This application is a continuation of application Ser. No. 06/587,045, filed 3/7/1984, now abandoned.

FIELD OF THE INVENTION

The present invention is related to apparatus for use in making a woven seam in woven fabric belts, and more particularly to apparatus for forming woven seams in long fabric belts of the type employed in the paper industry in the Fourdrinier section of paper machines.

BACKGROUND PRIOR ART

Machinery used in the paper industry commonly employs large woven fabric belts which may be 150 feet long and 200 inches wide or more. A belt of this type is woven on large looms and then the opposite ends of the belt are woven together in a laborious process to form a seamless belt. It is critical to the paper making process that the woven seam be flawless. The process for forming the woven seam has, up to now, been done primarily by hand and by fraying the filaments at the opposite ends of the woven fabric belt and by then weaving the filaments together into the other end of the belt. Since these woven belts may comprise a densely woven fabric of very fine filaments or threads, the manual seam weaving process is exacting and time consuming. It is difficult for the seam weaver to grasp the individual filaments in the proper sequence, yet it is imperative that the seam weaver produce a perfect and continuous woven product. If the filaments are not woven together in the proper order, the fabric is worthless. The seam weaver must also take great care to be sure that the woven filaments are not twisted and such that each knuckle of the seam filaments is properly oriented with respect to the other threads of the fabric.

As a result of the extreme care which must be taken with the seam weaving process, manual seam weaving requires a considerable number of hours of work for wide belts. Due to the time required and the level of skill necessary, the seam weaving process is very expensive and forms a substantial portion of the cost of the finished product.

Due to the expense of this manual seam weaving process, efforts have been made to automate the method for forming a woven seam and endless woven fabric belts. Prior to the present invention, such efforts have been unsuccessful.

One prior art apparatus has been developed for use in combination with manual seaming and for forming the shed openings. This apparatus is intended to reduce some of the effort required by the seam weaver yet it still requires manual weaving operations. This apparatus employs Jacquard devices such as those produced by Samuel Dracup & Sons, Ltd., Lane Close Mills, Great Horton, Bradford West Yorkshire, England.

Another example of the prior art attempts at providing a mechanized means for forming a woven seam is illustrated in the German Koller et al. patent disclosure No. P 30 25 909.7-26, published Feb. 4, 1982. While this structure or apparatus purports to provide an automatic seam weaving machine, it includes a number of different deficiencies. For example, no functional method is provided by Koller for separating the warp threads one from another, nor does Koller provide a commercially suitable means for weaving the warp threads through the weft threads to thereby form the woven seam.

SUMMARY OF THE INVENTION

The present invention provides an improved method and apparatus for forming a woven seam joining together the opposite ends of woven fabrics such as fabrics employed on the Fourdrinier section of paper machines. The apparatus of the invention provides a means for mechanically forming a seam and greatly reduces the amount of hand labor otherwise required in the seaming operation.

The apparatus of the invention is adapted for use with a frame apparatus for use in supporting the opposite ends of the woven fabric in spaced parallel relation and wherein most of the weft threads are removed from a portion of the ends of the fabric so as to leave a fringe of warp threads. A strip of fabric cut from one of the ends is also positioned between the opposite ends of fabric. The warp threads are removed from this strip of fabric. The warp threads forming the fringe of the opposite ends of the woven fabric can then be woven into the weft threads of the strip so as to form a woven seam joining the opposite ends of the fabric.

The apparatus embodying the invention includes means for forming a shed opening in the weft threads of the strip, and means for mechanically gripping a first warp thread from the fringe of one end of the fabric and then conveying that warp thread through the shed opening and then beating that warp thread against the seam face. The shed opening is then changed and a warp thread from the fringe of the other end of the fabric is conveyed through the shed opening in the opposite direction and then beat against the seam face. This operation continues wherein successive warp threads from alternate ends of the fabric are woven into the weft threads of the strip.

The apparatus basically comprises a means for forming a shed opening of the weft threads, means for gripping a selected warp thread of the fringe and for pulling it away from the other warp threads of the fringe, and means for laying this warp thread into the weft and pulling it tight or tensioning the warp thread and then beating it against the seam face of the seam being formed.

One of the principal features of the invention is the means provided for mechanically gripping selected successive individual warp threads and for conveying them through the shed opening.

Another of the principal features of the invention is the means provided for forming the shed opening. This means includes the provision of a Jacquard machine supported such that the needles of the Jacquard machine project vertically upwardly and with the needles positioned below the weft threads and supported such that they are independently vertically movable. A spring box is mounted above the weft threads and a plurality of heddles are connected to the spring box and to the needles of the Jacquard machine. Each of the heddles is constructed so as to engage an individual one of the weft threads. The Jacquard machine operates to cause vertical movement of the heddles so as to cause consequent vertical movement of selected ones of the weft threads and formation of a shed opening. The use of a Jacquard machine facilitates control of the shed opening to produce any desired combination and the position of the joins produced can have any selected combination and the seam width can be varied substantially depending upon the fabric being seamed.

Another of the principal features of the invention is in the construction of the heddles and the provision of heddles which do not require threading of weft threads through the eyelets as is required by prior art or conventional eyelets of a Jacquard device. The heddles provided by the present invention are constructed such that they can be placed around the weft threads and to engage the weft threads, and it is not necessary to thread the weft threads through the heddles. The heddles are also constructed such that once they surround a weft thread, the weft thread is freely slideable in the heddle in the direction of the weft thread and this prevents stretching of the weft threads.

Another of the principal features of the invention is the means provided for beating the warp thread against the seam face. In a preferred form of the invention, this means includes a pivoting reed including a plurality of closely spaced parallel pivoting reed dents. The upper ends of the reed dents project between the weft threads such that a reed dent is positioned between each pair of weft threads. The reed dents are supported for movement between a retracted position spaced from the seam face and a position where they are closely adjacent the seam face. The reed dents are supported in their retracted position when the warp thread is conveyed through the shed opening and then moved to the second position once the warp thread is tensioned. Means are also provided for causing successive ones of the reed dents to beat the warp thread against the seam face. The beating of the warp thread against the seam face propagates across the seam face. This has the effect of causing the knuckles of the warp threads to be properly positioned with respect to the knuckles of the weft threads and tends to prevent undesirable twisting of the warp threads.

Another feature of the invention is the provision of means for supporting the seam weaving apparatus described above such that it will move along the length of the seam as the seam is formed.

Another feature of the invention is that the apparatus permits the woven fabric to be supported such that it can be either tented or undraped.

Another feature of the invention is the provision of means for causing sequential operation of the Jacquard machine and the means for separating the selected warp thread and for conveying it through the shed opening. This apparatus precludes non-sequential operation of the apparatus for feeding the warp threads through the shed opening and thereby tends to prevent the formation of weave sequence flaws in the woven seam.

Another feature of the apparatus embodying the invention is the provision of means for automatically interrupting operation of the apparatus in the event that the apparatus for feeding the warp threads through the shed opening fails to properly grip the selected warp thread.

One of the advantages of the apparatus embodying the invention is that it is capable of making any seam style required and is not limited to producing just one type of seam style. This feature is provided by the employment of the Jacquard heddling apparatus in combination with the other apparatus to be described below. The joint locations can be programmed and located as required.

Another advantage of the apparatus embodying the invention is that the controlled sequence of operation can be reversed. In the event that the apparatus produces a flaw in the woven seam thereby causing the machine to stop, the operator can reverse the heddling sequence to permit the seam to be unwoven and corrected.

Various other features and advantages of the invention will be apparent by reference to the following description of a preferred embodiment, from the drawings, and from the claims.

BRIEF DESCRIPTION OF THE DRAWINGS

FIG. 8 is a view taken along line 8—8 in FIG. 6.

FIG. 14 is an enlarged partial view of the spring box shown in FIG. 5.

Figure 1:
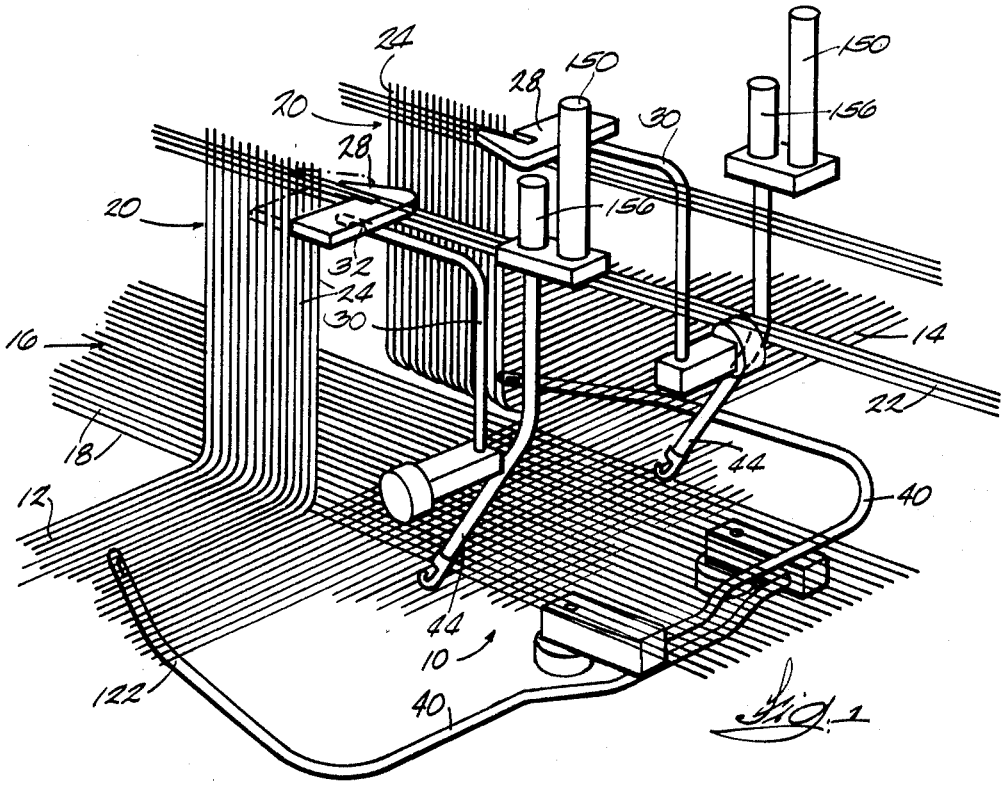
FIG. 1 is a schematic perspective view of the apparatus embodying the invention and for use in separating the warp threads from the fringe and for feeding them through a shed opening formed in the weft threads.

Before describing preferred embodiments of the invention in detail, it is to be understood that the invention is not limited to the details of construction and to the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an apparatus embodying the invention and for forming a woven seam 10 joining the opposite ends 12 and 14 of a woven fabric belt. The opposite ends 12 and 14 of the woven fabric belt are illustrated as being supported in spaced-apart relation. A strip 16 of woven material, having been cut from one of the opposite ends 12 and 14 of the belt, is supported between the opposite ends of the belt. This strip is clamped at one end and weights are attached to the opposite end of this strip so that it is pulled taut. The warp threads are removed from the strip of material 16 located between the opposite ends of the belt leaving only the weft threads 18.

The opposite ends 12 and 14 of the fabric can be supported in a conventional manner, with one end 12 of the fabric supported over a long metal tube and the other end 14 similarly draped over a long metal tube. The metal tubes are supported at their opposite ends in a conventional manner as is used in a manual seam weaving process and with the metal tubes in spaced apart parallel relation. The metal tubes are spaced apart by a dimension sufficient to house the seam therebetween, and the seam weaving machine embodying the present invention is positioned between the metal tubes and is supported for linear movement in the direction of the longitudinal axis of elongated metal tubes.

The opposite ends 12 and 14 of the belt each include a fringe 20 formed by removing a majority of the weft threads. In a preferred form of the invention, a few weft threads are left at the edge of the fringe 20 to form a relatively narrow ribbon 22 functioning to maintain the warp threads 24 of the fringe 20 in the proper position and to maintain proper relative alignment of the warp threads 24 with respect to one another. The opposite ends of the ribbon 22 are supported such that the warp threads 24 forming the fringe 20 extend vertically upwardly from the peripheral edges of the strip 16 and in spaced apart facing relation on opposite sides of the strip.

The woven seam 10 is formed by separating a first one of the warp threads or strands 24 of the fringe 20 and weaving it into the weft threads 18 of the strip. Then a warp thread or strand 24 of the fringe at the opposite end of the strip is separated, and this strand is woven into the weft threads 18 of the strip. This cycle is repeated until a seam has been woven along the entire width of the belt being seamed.

Figure 2:
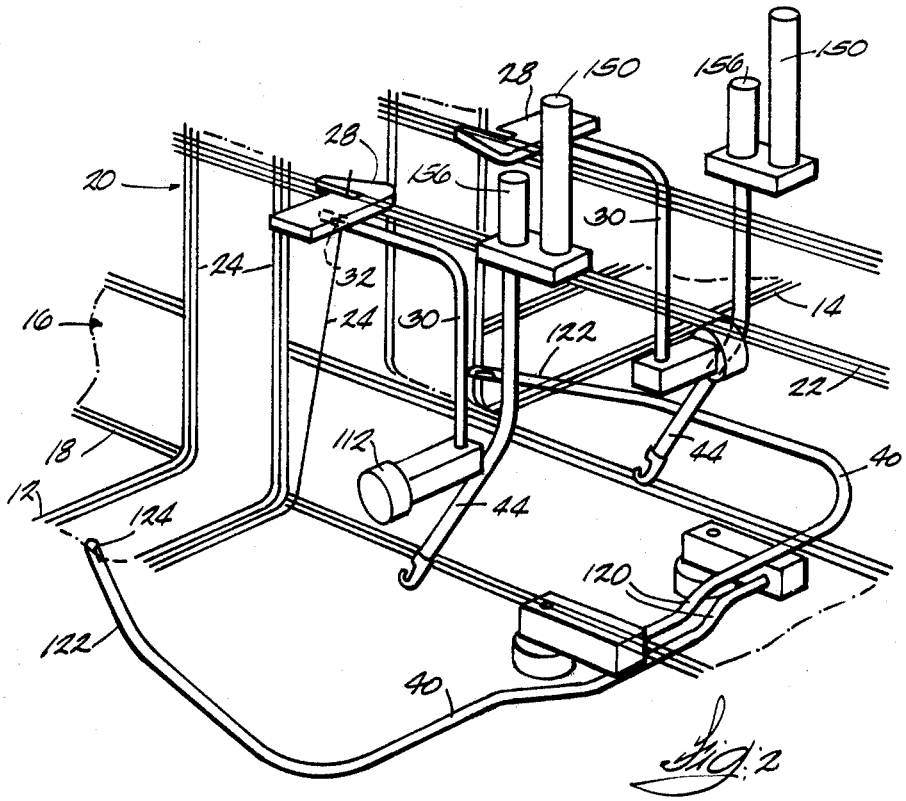
FIG. 2 is a view similar to FIG. 1 and showing a thread separator having separated a warp thread from the fringe of one end of the fabric.

FIGS. 1 and 2 illustrate schematically the means provided by the apparatus embodying the invention for separating successive ones of the warp threads 24 of the fringe 20 such that they can then be woven into the weft threads 18 of the strip 16. While this means for separating will be described in greater detail hereinafter, in the construction shown in FIGS. 1 and 2, it includes a reciprocably moveable thread separator 28, the thread separator 28 being moveable from a retracted position shown in solid lines in FIGS. 1 and 2 to a second or forward position wherein the thread separator 28 can engage or grip the next successive warp thread 24 of the fringe 20. The thread separator 28 then moves to its retracted position pulling the gripped thread 24 away from the remainder of the fringe 20. One such thread separator 28 is positioned adjacent each fringe 20.

The apparatus embodying the invention further includes a pair of transfer arms 30 positioned on opposite sides of the seam 10. Each transfer arm 30 is supported for pivotal movement about a horizontal axis parallel to the warp threads in the woven seam 10. The free end 32 of each transfer arm 30 includes means for gripping a warp thread 24 held by the thread separator 28 when the thread separator 28 is in the retracted position as shown in FIG. 2. The free end 32 of the transfer arm 30 is positionable so that it can grip the selected warp thread 24 when the thread separator 28 moves to the retracted position. The transfer arm 30 is then pivotable from the thread gripping position shown in FIGS. 1 and 2 to a position shown in FIG. 3 wherein the free end of the warp thread 24 is moved generally forwardly and downwardly as seen in FIGS. 1 through 4 to the position shown in FIG. 3 wherein the free end of the warp thread 24 is moved to the plane of the seam 10.

Figure 3:
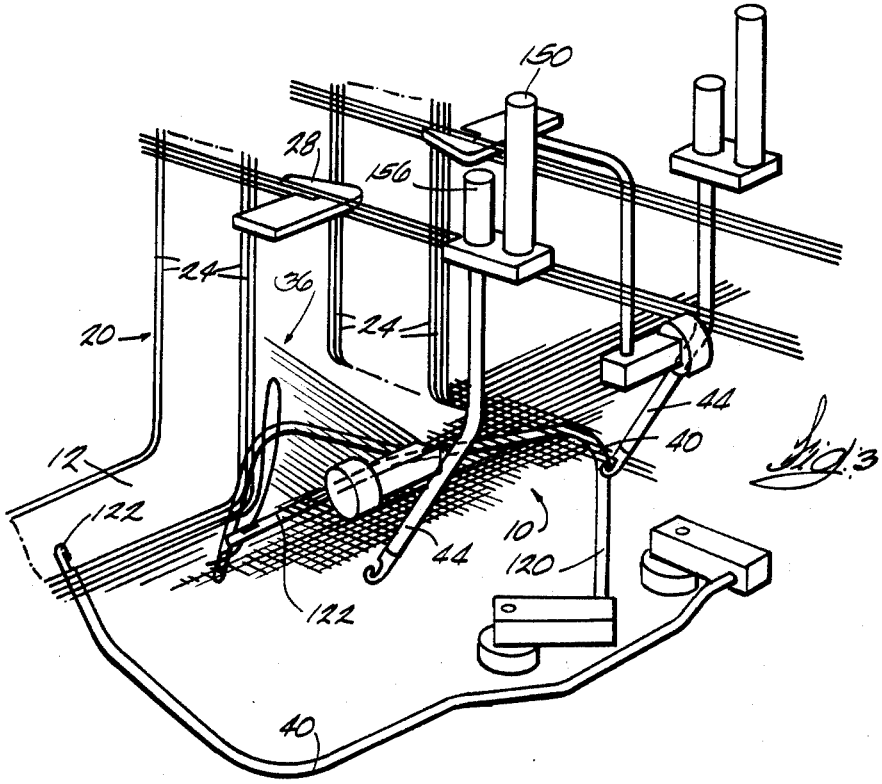
FIG. 3 is a view similar to FIGS. 1 and 2 and showing a transfer arm transferring the separated thread to an interlace arm which extends through the shed opening.
Figure 4:
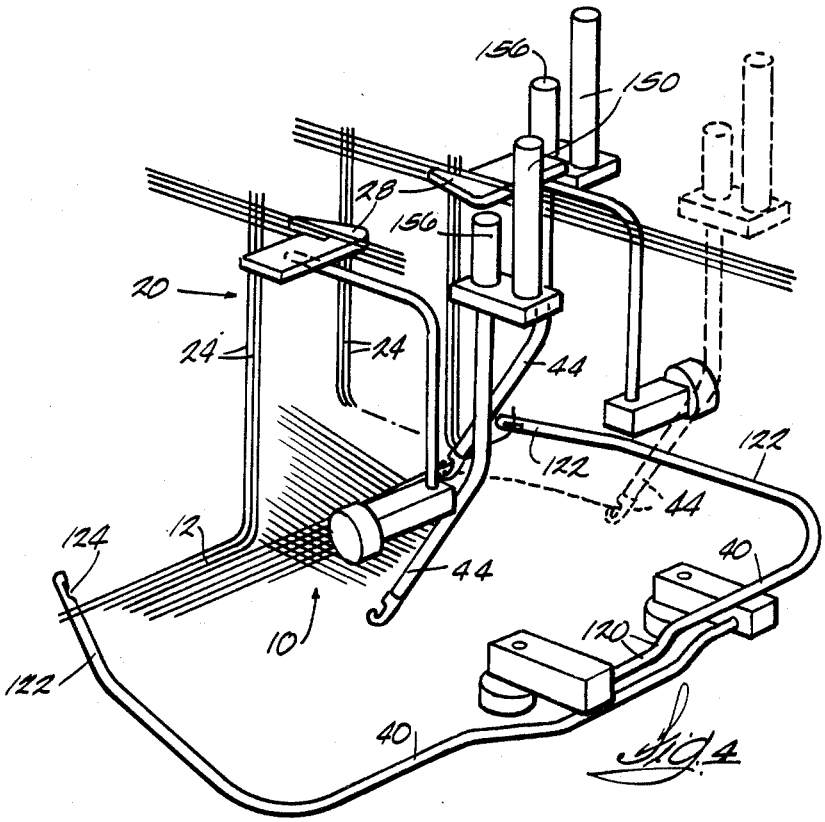
FIG. 4 is a view similar to FIGS. 1–3 and further showing the interlace arm pulling the selected warp thread through the shed opening.

The apparatus embodying the invention further includes means for causing the weft threads 18 of the strip 16 to form a shed opening 36 as illustrated in FIGS. 3 and 4. While this apparatus will be described in greater detail hereinafter, it generally includes a Jacquard device of the type conventionally used to form a shed opening in weaving apparatus.

The apparatus embodying the invention further includes a pair of interlace arms 40 supported for movement between a position as shown in FIG. 3 wherein the free end 42 of the interlace arm 40 extends through the shed opening 36 to grip the warp thread 24 held by the free end 32 of the transfer arm 30, and a retracted position shown in FIG. 4. The free end of the warp thread 24 is pulled by the interlace arm 40 through the shed opening 36 to an opposite side of the seam 10.

The apparatus embodying the invention further includes a pair of extractor arms 44 positioned on opposite sides of the seam 10, the extractor arms 44 being positioned closely adjacent the longitudinal edges of the seam 10 to be formed. Each extractor arm 44 is adapted to move between an extended position as shown in FIG. 4 and wherein the free end of the extractor arm 44 is in a position to grip a warp thread 24 held by the free end of the interlace arm 40. The extractor arm 44 can thus grip the end of the warp thread 24 which has been pulled through the shed opening 36 by the interlace arm 40 as shown in FIG. 4, and the extractor arm 44 can then be moved rearwardly to the retracted position shown in phantom in FIG. 4 wherein the gripped warp thread 24 is pulled against the seam face 46.

Using this apparatus, a selected warp thread 24 of the fringe 20 is separated from the remaining warp threads of the fringe, and fed by the transfer arm 30 and the interlace arm 40 through the shed opening 36. The warp thread 24 is then pulled against the seam face 46 by the extractor arm 44. After the warp thread 24 is pulled back by the extractor, a lay and reed mechanism to be described hereinafter move forward and the reed rolls to beat in the warp thread, and the reed then moves back to the neutral position. The shed opening 36 is then changed or reversed by operation of the Jacquard machine referred to above, and a warp thread 24 from the fringe 20 on the opposite side of the seam 10 is then selected and separated from that fringe. This warp thread 24 is then gripped by a transfer arm 30 and conveyed to a position where it can be gripped by the free end of an interlace arm 40 extending through the shed opening 36. The extractor arm 40 can then engage the warp thread 24 so as to pull it against the seam face 46. After the warp thread 24 is pulled back by the extractor, the lay and reed mechanism come forward and the reed rolls to beat in the warp thread, and the reed moves back to the neutral position. This process is repeated continually until each warp thread of the fringes 20 is woven into the weft threads 18 of the strip 16 to thereby form a woven seam joining the opposite ends 12 and 14 of the woven belt.

Figure 5:
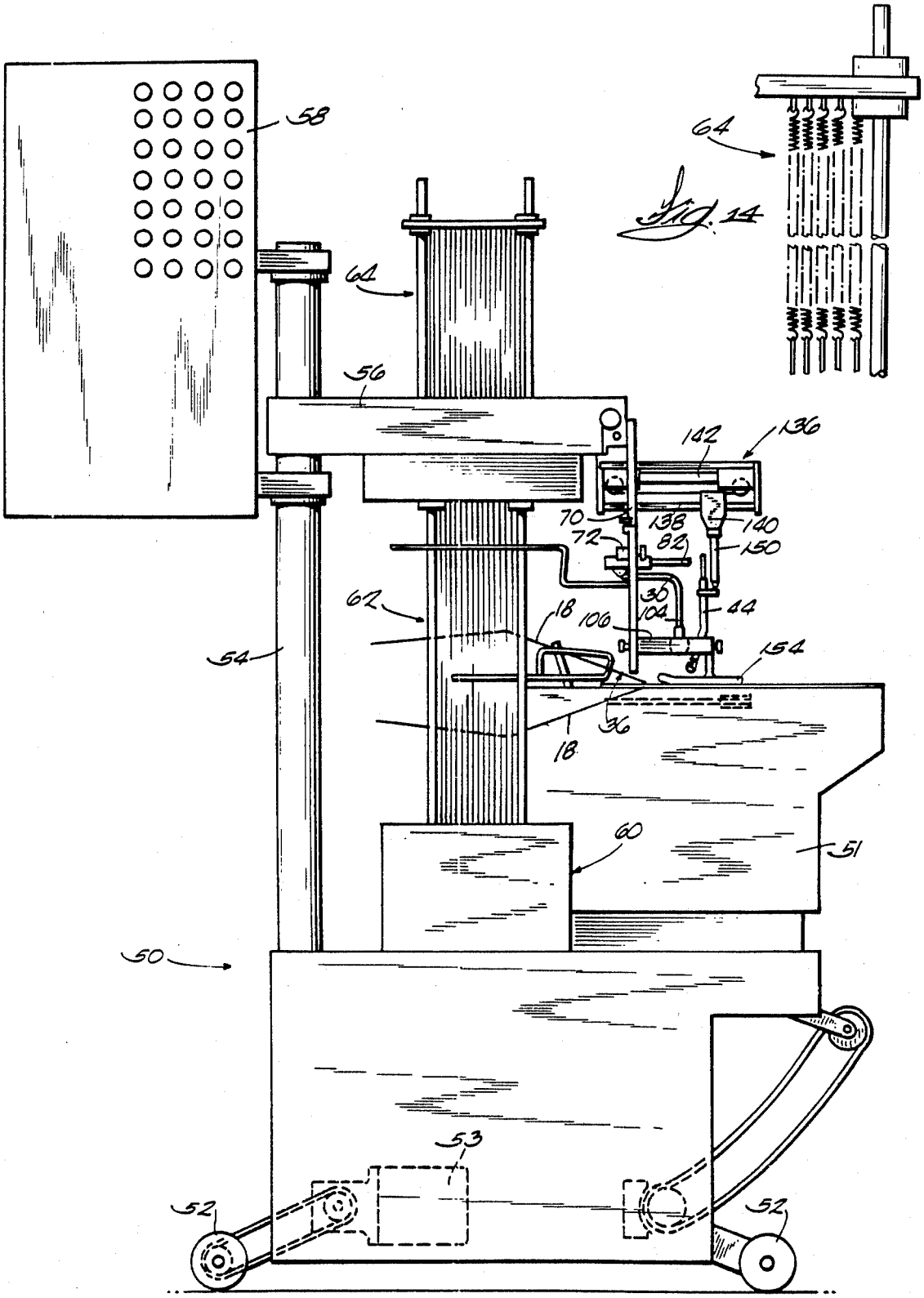
FIG. 5 is a side elevation view of apparatus embodying the invention.

FIG. 5 illustrates more particularly a preferred form of the apparatus embodying the invention and adapted to accomplish the seam weaving process described above. The apparatus shown in FIG. 5 includes a frame structure 50 adapted to support the seam weaving apparatus described above and supported for movement by a plurality of wheels 52. The frame 50 is supported for movement such that the seam weaving apparatus supported by the frame 50 can move linearly along the length of the seam 10 as the seam weaving process proceeds. The machine frame 50 includes a vertically positioned column 54 supporting a horizontal cantilevered frame 56. The cantilevered frame in turn supports the thread separating and weaving apparatus described above. The vertical column 54 also supports a control box 58 adapted to house conventional pneumatic controls used to control the operation of the thread separating apparatus and the weaving apparatus. The frame 50 further includes means providing a horizontal flat surface for supporting the woven seam 10 joining the opposite ends 12 and 14 of the woven fabric belt. In the illustrated construction this flat surface is formed by a sheet metal housing 51 supported by the frame 50 and including a planar horizontal upper surface.

The frame 50 also supports a conventional Jacquard machine 60. The Jacquard machine being adapted to control the shed opening formed by the weft threads 18 of the strip 16. In one preferred form of the invention, the Jacquard machine can be a Jacquard device produced by Samuel Dracup & Sons, Ltd., Lane Close Mills, Great Horton, Bradford West Yorkshire, England. This conventional and commercially available Jacquard machine 60 is supported by the frame 50 such that the needles of the Jacquard machine project upwardly and are adapted to move vertically in response to operation of the Jacquard machine.

The frame also supports a heddling assembly 62 and a conventional spring box 64 mounted vertically above the Jacquard machine 60. As is conventional, the spring box 64 includes a large number of vertically mounted coil springs, at least one spring being provided for each of the weft threads 18 of the strip 16. A plurality of heddles 66, to be described in greater detail hereinafter, are mounted between the springs of the spring box 64 and the vertically reciprocal needles of the Jacquard machine 60. An individual heddle 66 surrounds each one of the weft threads 18, and the heddles 66 are connected to respective ones of the vertically oriented springs of the spring box 64 and to respective ones of the needles of the Jacquard machine 60. As is conventional, the Jacquard machine 60 operates to cause selected ones of the needles to be moved vertically thereby causing a consequent vertical movement of the heddle 66 connected to that needle. Such movement of the heddles 66 results in movement of the weft threads 18 and formation of a shed opening. It will be understood by those skilled in the art that by the use of the Jacquard heddling device, the shed opening 36 formed by the weft threads 18 can be varied in any desired pattern and the width of the shed opening 36 can be varied depending upon the seam style desired.

Figures 7, 13:
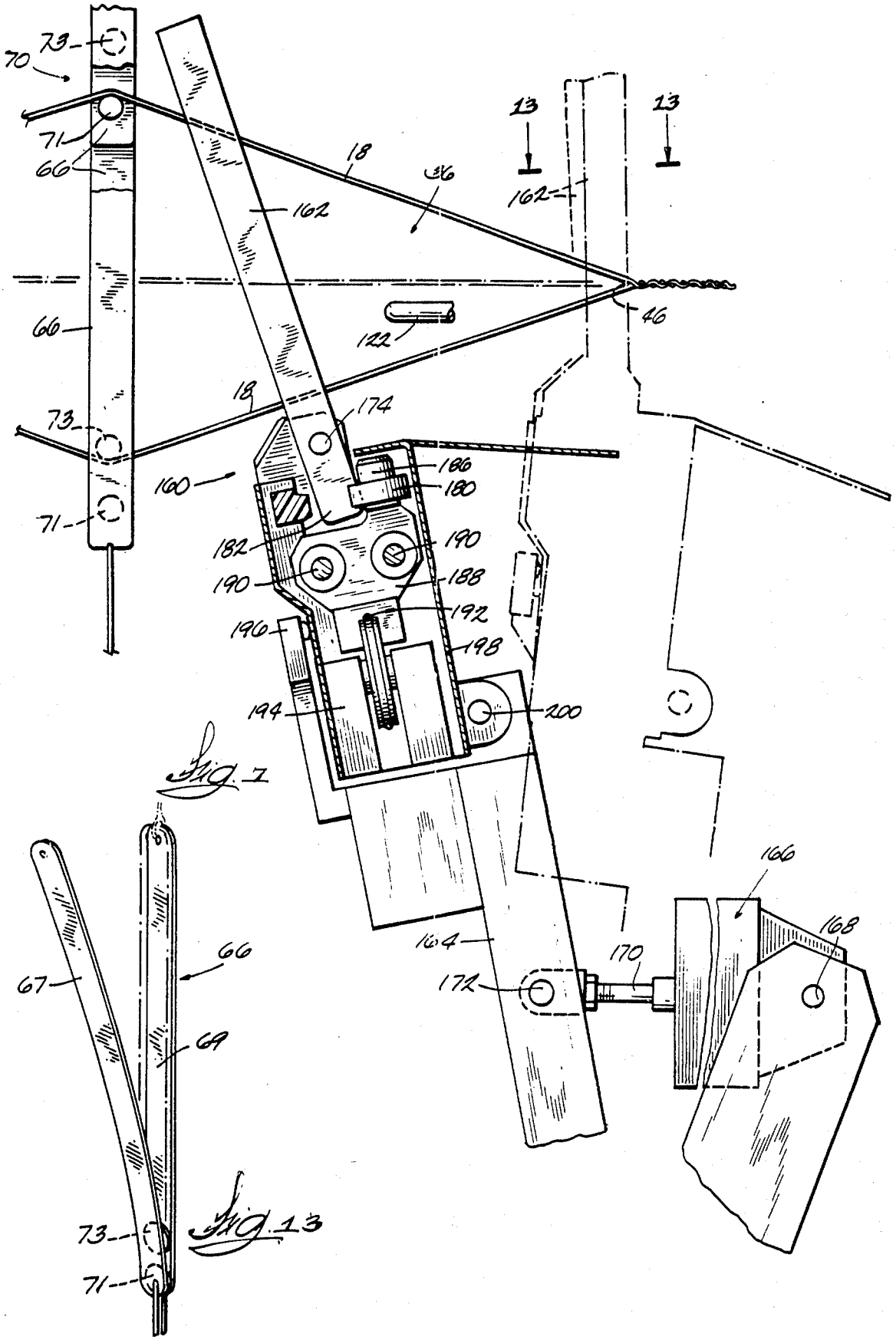
FIG. 7 is an enlarged side elevation view of a portion of the apparatus illustrated in FIG. 5 and illustrating the lay and reed mechanism and the heddles forming the shed opening.
FIG. 13 is a perspective view of a heddle illustrated in FIG. 7.
Figure 6:
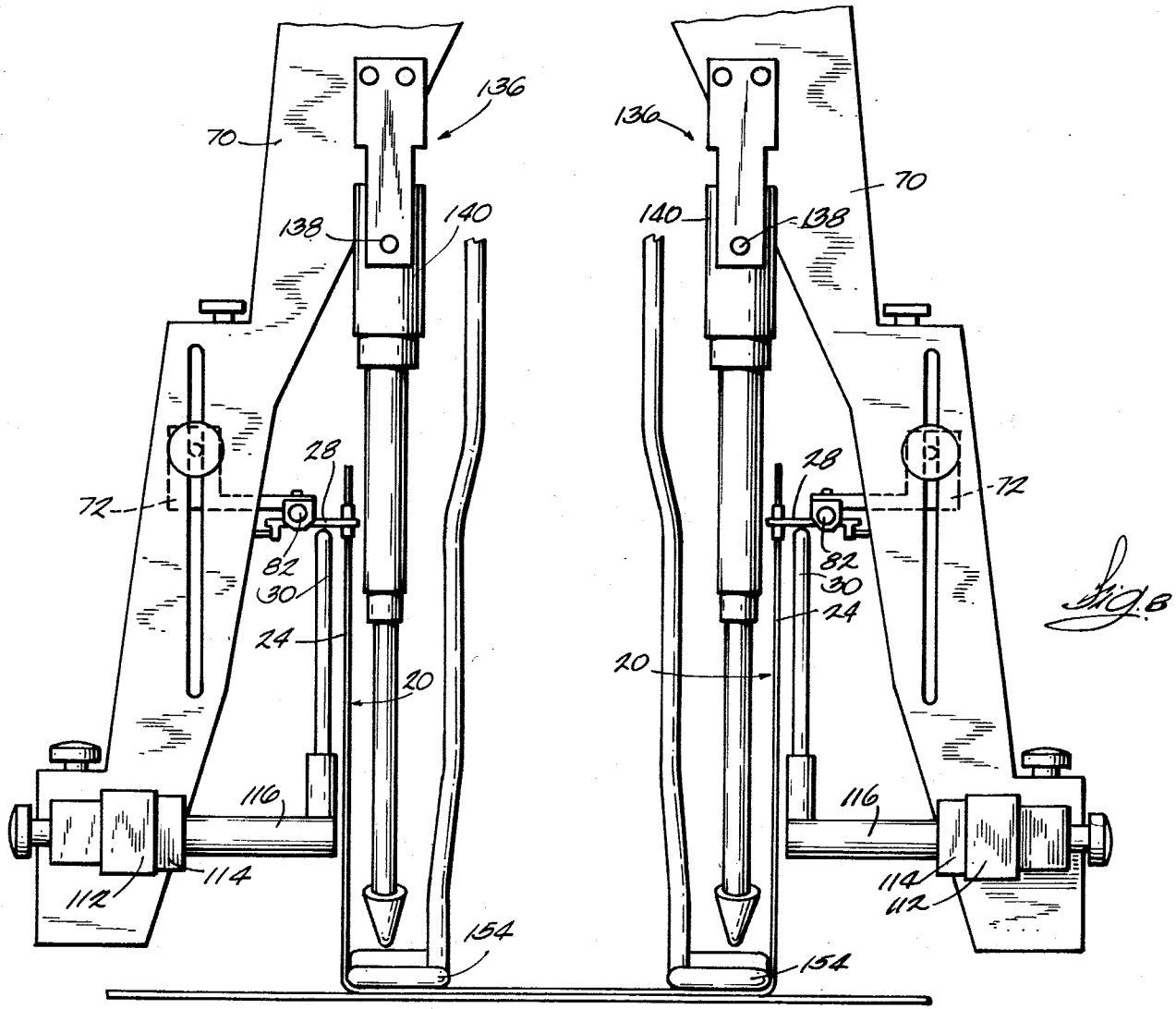

One of the features of the present invention is the provision of heddles 66 which can be slideably placed over the weft threads 18 and wherein the heddles are constructed such that the individual weft threads 18 do not have to be threaded through the heddles 66. Referring more particularly to the construction of the heddles illustrated in the drawings, as shown in FIG. 13 each heddle is comprised of a pair of thin metal blades 67 and 69 of substantially the same length. These blades 67 and 69 are positioned in parallel facing relation and a thin circular metal disc 71 is positioned between the ends of the blades so as to support these ends of adjacent parallel blades in spaced parallel facing relation. The circular metal disc has a thickness slightly greater than the thickness of the weft threads. The blades 67 and 69 are fixedly joined to the metal disc 71. While the means for joining the blades 67 and 69 to the metal disc could have various constructions, in one preferred form of the invention, the blades 67 and 69 are laser welded to the metal disc 71. The heddle 66 also includes a second metal disc 73 positioned between the blades 67 and 69 adjacent the first metal disc 71 but spaced therefrom. The second metal disc 73 is fixed to one of the blades 67 and includes a planar side adapted to contact the other metal blade 69. In a preferred form of the invention, the blades 67 and 69 are flexible, and since the blades are joined together at only one end, they can be spread apart as shown in FIG. 13.

In operation, once the strip 16 of woven material is laid in place and once the warp threads are removed, heddles 66 are placed over individual weft threads 18. The free ends of the blades 67 and 69 of the heddles 66 are separated and slipped over weft threads 18. The blades 67 and 69 are sufficiently flexible that the blade 67 can be pulled away from the second disc 73 sufficiently that the weft thread 18 can be passed between the blade 67 and the second disc so as to be positioned between the discs 71 and 73 and the blades 67 and 69. The weft thread is thus securely held in the heddle 66.

Referring now more particularly to the apparatus for separating successive ones of the warp threads 24 from the fringe 20, such that those successive warp threads 24 can be conveyed through the shed opening 36, the means for separating the warp threads is illustrated more particularly in FIGS. 6 and 8–11. The apparatus on one side of the woven seam 10 for separating warp threads 24 and for feeding them into the weft threads 18 so as to form the woven seam is a mirror image of the apparatus provided on the opposite side of the seam. Accordingly, only the apparatus on one side of the seam will be described in detail.

Figure 11:
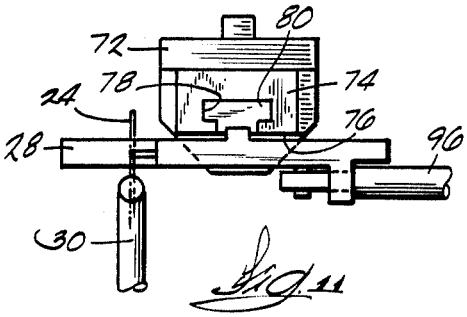
FIG. 11 is a view taken along line 11—11 of FIG. 9.

In the illustrated construction, a pair of depending arms 70 extend downwardly from the free end of the cantilevered frame 56, each of the arms 70 having an upper end fixed to the free end of the cantilevered frame 56. The downwardly depending arms 70 are substantially the same in construction and accordingly, only one will be described in detail. The downwardly depending arms 70 each support a horizontally extending support arm 72 (FIGS. 6, 8 and 9) and a slide track or slide body 74. The means for separating successive warp threads 24 from the fringe 20 includes a separator body 28 adapted to be horizontally moveable from a retracted position shown in phantom in FIG. 9 to an extended position wherein the separator body 28 can engage and grip the next successive one of the warp threads 24 of the fringe 20. Means are also provided for supporting the separator body 28 for such reciprocal movement. While the separator body 28 could be supported in various ways, in the illustrated construction, and as shown in FIG. 11, the lower surface 76 of the slide track 74 includes an elongated, T-shaped groove 78 extending along the length of the slide track 74, and a T-shaped slide member 80 is housed in the groove 78 and is reciprocably moveable therein in the direction of the longitudinal axis of the slide track 74. The separator body 28 is fixed to the slide member 80 so as to be reciprocably moveable with the slide member 80.

Means are also provided for causing reciprocable linear movement of the separator body 28 between the extended position and the retracted position. In the illustrated embodiment of the invention, this means for causing such movement includes a pneumatic cylinder 82 and piston 84. The cylinder 82 includes a forward end fixedly joined to the slide track 74, and the free end of the piston 84 is connected to the slide member 80. While the pneumatic cylinder 82 could comprise any suitable commercially available cylinder assembly, in one preferred form of the invention, the piston and cylinder can be commercially available products manufactured by Kuhnke Pneumatic, Malente/Holstein, West Germany.

Referring more particularly to the separator 28, in the illustrated construction, it comprises a very small L-shaped plate, the plate being positioned such that it defines a generally horizontal plane and the leg of the "L" 86 extends forwardly toward the fringe. The separator body 28 also includes a groove 88 formed at the juncture of the leg 86 of the separator and the body portion, this groove 88 being adapted to house a plurality of warp threads 24 of the fringe 20. The separator 28 also includes a selection needle 90 housed in a narrow generally planar and horizontally oriented slot 91 bisecting a portion of the separator body 28. The selection needle 90 is supported there for horizontal reciprocal movement in the narrow planar slot 91 in a direction perpendicular to the vertical plane defined by the fringe 20 of warp threads 24. The selection needle 90 includes a very small hook 92 adapted to engage a single warp thread 24 of the fringe 20 and to clampingly force that warp thread 24 against the surface 94 of the leg portion 86 of the separator body.

Means are also provided for causing the selection needle 90 to move reciprocably between a retracted position and a position wherein the hook portion 92 can engage a warp thread. In the illustrated construction, this means comprises a small pneumatic cylinder 96 fixed to the separator body 28 and a piston 98 being connected to the selection needle 90. The cylinder 96 is connected to a source of air pressure by a flexible hose 100.

Means are also provided for resiliently supporting the selection needle 90 such that as the separator body 28 moves from the retracted position to the extended position wherein the selection needle 90 engages the leading warp thread 24, the selection needle 90 will yield to the force applied on the selection needle 90 by the warp thread 24 thereby preventing the separator apparatus from causing the warp threads 24 to bunch up when the warp threads are engaged by the selection needle 90. In the illustrated construction, the horizontal narrow slot 91 in the separator body supports the selection needle 90 such that it is moveable in the slot 91 in a generally horizontal plane and toward and away from the warp threads 24. A very light leaf spring 102 is mounted in the slot 91 and yieldably resiliently supports the selection needle 90. The leaf spring 102 is particularly selected to support the selection needle but to permit sufficient movement of the selection needle when it engages the lead warp thread 24 and so as to prevent bunching of the warp threads.

Figure 6:
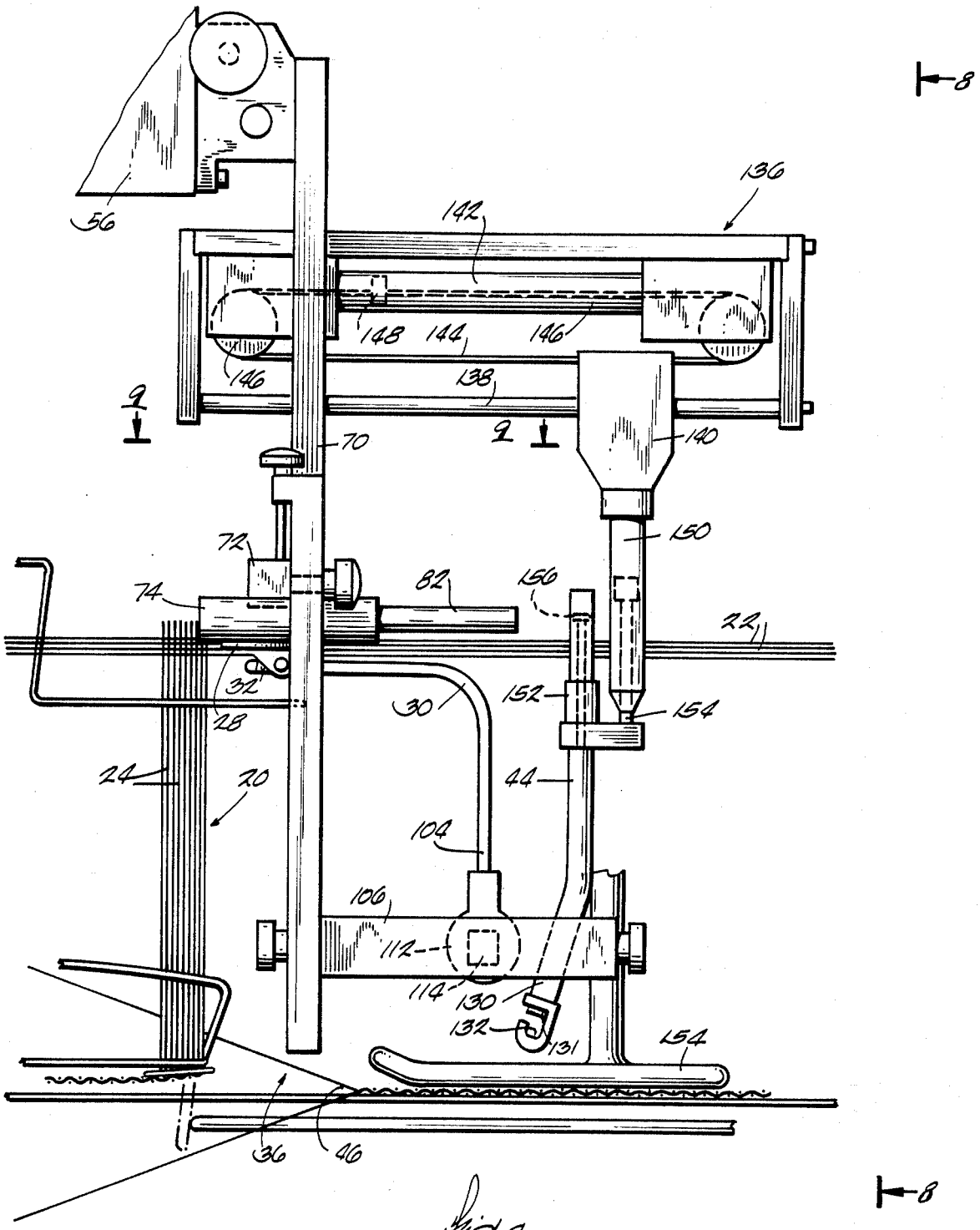
FIG. 6 is an enlarged side elevation view of the portion of the apparatus illustrated in FIG. 5.

As best illustrated in FIG. 6, in a preferred form of the invention, the separator body 28 is supported such that it is positioned between weft threads 22 of the ribbon supporting the free edge of the warp threads 24. The separator body 28 is adapted to be slideable reciprocable in the direction of the weft threads 22 and between the weft threads. The weft threads 22 will thus ensure alignment or proper positioning of the ends of the warp threads 24 with respect to the separator body 28.

Figure 9:
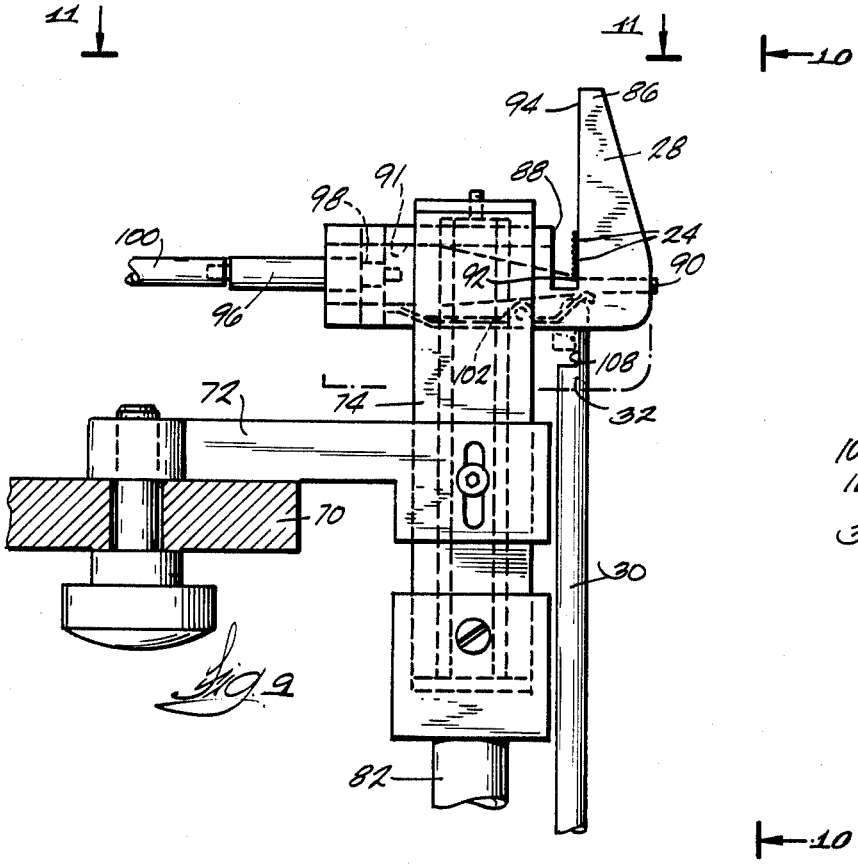
FIG. 9 is a view taken generally along line 9—9 of FIG. 6 and showing the thread separator apparatus.
Figure 12:
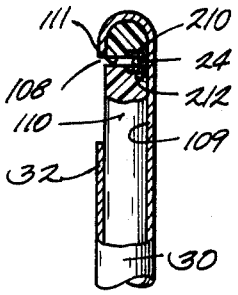
FIG. 12 is an enlarged view of the end of transfer arm of the apparatus shown in FIG. 9 and with portions shown in cross section.
Figure 10:
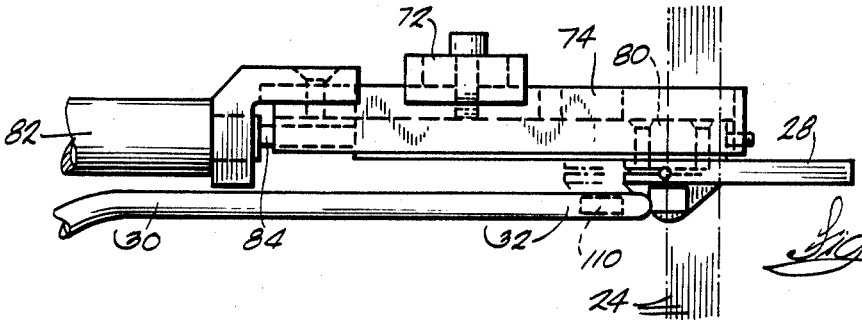
FIG. 10 is a view taken along line 10—10 in FIG. 9.

As previously stated, means are also provided for gripping the warp thread 24 pulled away from the fringe by the separator 28 and for moving the free end of the warp thread 24 to a position adjacent the shed opening 36 and to one side of the shed opening 26 whereby the warp thread 24 may be gripped by an interlace arm 40. This means includes the transfer arm 30 best illustrated in FIGS. 6 and 8–11. The transfer arm 30 is generally L-shaped and includes one end 32 adapted to grip the warp thread 24 and an opposite end 104 supported by the frame. More particularly, the frame or support structure includes a rearwardly and horizontally extending rigid arm 106 adapted to support the opposite end 104 of the transfer arm 30. The free end of the transfer arm, i.e. that end 32 of the transfer arm 30 adapted to be positioned adjacent the separator assembly, includes means for gripping the selected separated warp thread 24. While the means for gripping could have other construction, as best shown in FIGS. 9 and 12, a notch or opening 108 is cut in the free end 32 of the transfer arm 30, and the free end of the transfer arm is hollow and functions as a cylinder 109. The cylinder houses a pneumatically operated piston 110, the piston 110 being supported for movement between a first position wherein the notch 108 is open and a second position wherein the piston 110 moves toward the free end of the transfer arm 30 to clamp the selected warp thread 24 against the end of the notch 108 to thereby clampingly engage the warp thread 24 as shown in FIG. 12.

Means are also provided for causing pivoting movement of the transfer arm 30 such that the free end of the warp thread 24 is carried downwardly toward the plane of the woven seam and inwardly from a vertical plane adjacent the edge of the seam to a position toward the center of the seam. In the illustrated construction, this means comprises a pneumatic rotary cylinder 112 fixed to the support arm 106, and the piston 114 of the rotary cylinder 112 also defines a cylinder of a pneumatic linearly extensible cylinder assembly. A reciprocable piston 116 is fixed to the end 104 of the transfer arm 30. While the rotary piston 114 and cylinder 112 could comprise any conventional rotary pneumatic piston and cylinder, in one embodiment of the invention, they can comprise a commercially available rotary piston and cylinder manufactured by Microtechnik, Grenchen/-Switzerland.

In operation of the transfer arm 30, it is initially positioned as shown in FIG. 6 with the piston 110 (FIG. 12) housed in the free end 32 of the transfer arm 30 in a retracted position. When the separator 28 functions to grip a warp thread 24 and pull it away from the remaining warp threads of the fringe 20, and when the separator body 28 moves rearwardly, the warp thread 24 is pulled into the notch 108 in the free end 32 of the transfer arm 30. The piston 110 in the free end 32 of the transfer arm 30 is then actuated so as to clamp the warp thread 24 against the end wall 111 of the notch 108. The linear piston 116 and cylinder 114 are then actuated to cause inward movement of the transfer arm 30, i.e. movement of the transfer arm 30 toward the center of the seam 10. The free end 32 of the warp thread 24 is thus moved away from the separator apparatus 28. The rotary cylinder 112 of the transfer arm is then actuated to cause rotation of the transfer arm 30 from the position shown in FIG. 6 to a position wherein the free end of the transfer arm 30 is adjacent the plane of the seam.

Means are also provided for gripping the warp thread 24 held by the transfer arm 30 for pulling the free end of the warp thread through the shed opening 36 to the other side of the seam area. In the illustrated arrangement, this means includes the interlace arm 40 supported for pivotal movement about a generally vertical axis. In the illustrated arrangement, the interlace arm 40 is generally L-shaped and includes one end 120 pivotally supported for pivotal movement about a vertical axis and an opposite or free end 122 supported for movement in a generally horizontal path from one side of the seam 10 through the shed opening 36 to an opposite side of the seam. The free end 122 of the interlace arm 40 is similar in construction to the free end 32 of the transfer arm 30 in that it also includes means for gripping a warp thread as illustrated in FIG. 12. More particularly, the free end 122 of the interlace arm 40 includes a notch 124 adapted to house the end of the warp thread, and the free end 122 of the interlace arm 40 is tubular so as to define a cylinder housing a piston moveable from a retracted position to a warp thread clamping position.

In operation of the interlace arm 40, prior to downward pivotal movement of the transfer arm 30, the interlace arm 40 will swing from a retracted position (FIG. 2) through the shed opening 36 to the position illustrated in FIG. 3 wherein the free end 122 of the interlace arm 40 is adjacent the edge of the seam 10. When the transfer arm 30 is then caused to pivot downwardly, the free end 32 of the transfer arm 30 will move downwardly over the free end 122 of the interlace arm 40 thereby draping the warp thread 24 over the free end 122 of the interlace arm 40 such that the warp thread 24 can be received in the notch 124 provided in the interlace arm 40. The piston in the free end of the interlace arm is caused to extend such that it will clampingly engage the warp thread 24, and the piston clamping means of the transfer arm 30 will release the warp thread. The transfer arm 30 will be pivoted to its original position, and the interlace arm 40 will also be returned to its retracted position (FIG. 4) with the free end 122 of the interlace arm 40 pulling the warp thread 24 through the shed opening.

It should be understood that in other applications, the interlace arm 40 could have other configurations, and other means could be provided for causing translational movement of the free end 122 of the interlace arm 40 for movement from the retracted position to a position wherein the free end of the interlace arm extends through the shed opening 36 to a position wherein the free end 122 of the interlace arm 40 extends through the shed opening 32 to a position where it can grip a warp thread 24 held by the transfer arm. For example, in other embodiments, the interlace arm could be linear and a relatively long stroke piston and cylinder could be provided for causing linear movement of an end of such an interlace means.

Means are also provided for gripping the end of the warp thread 24 supported by the free end 122 of the interlace arm 40 after the interlace arm has pulled the end of the warp thread 24 through the shed opening 36 and for pulling this free end of the warp thread rearwardly and upwardly out of the shed area and for causing the warp thread to engage the seam face 46. This means also provides means for keeping tension on the warp thread while reed dents can engage the warp thread and force the warp thread against the seam face 46. This means for gripping the end of the warp thread 24 includes an extractor gripper 44 which comprises a generally vertically extending arm. The lower end 130 (FIG. 6) of the extractor gripper arm 44 includes means for gripping the free end of the warp thread 24 held by interlace arm 40. In a preferred form of the invention, this means for gripping is similar to that provided on a free end of the transfer arm 30 and the free end 32 of the interlace arm 40 and comprises a piston and cylinder arrangement. The lower end 130 of the extractor gripper arm is tubular and functions as a cylinder housing a piston. The lower end 130 of the extractor arm 44 includes a notch 132 adapted to house the end of the warp thread 24, and a piston 131 housed in the lower end 130 is reciprocably moveable so as to clampingly engage the warp thread 24. Means are also provided for causing translational horizontal movement of the extractor arm 44 from a retracted position shown in FIG. 6 to a forward position wherein the extractor gripper can clampingly engage a warp thread extending through the shed opening 36. FIG. 4 illustrates one of the extractor arms 44 having been moved forwardly from the retracted position shown in phantom in FIG. 4 to a forward position wherein it can engage a warp thread 24. While the means for causing horizontal reciprocal movement of the extractor arm 44 could have various constructions, in the illustrated arrangement, the extractor arm 44 is supported for movement by a linear bearing 136 supported by an upper end of the support arm 70 which is in turn fixed to the free end of the cantilevered frame 56. The linear bearing 136 includes a horizontally extending rod 138, and the extractor arm 44 is supported by a slide member 140 supported on the rod 138 for linear reciprocable movement. Means are also provided for causing selected translational movement of the slide member 140 along the support rod 138. While this means could include a conventional pneumatic piston and cylinder, in the illustrated arrangement, the means for causing movement of the slide member 140 includes a commercially available pneumatic cable cylinder 142 manufactured by Martonair, Twickenhaun, England. The cable cylinder 142 generally includes a cable 144 reeved over a pair of pulleys 146. The slide member 140 is fixed to the cable 144. The cable cylinder 142 also includes a cylinder 146, and a piston 148 is housed in the cylinder 146. The cable 144 is connected to the piston 148. When air pressure is provided to the cylinder 146, the piston 148 causes movement of the cable 144 and translational movement of the slide member 140 on the support rod 138.

The extractor gripper assembly also includes means for causing selected vertical movement of the lower end 130 of the extractor arm 44. In a preferred form of the invention, this means comprises a pair of pneumatic cylinders 150 and 152 mounted in vertically stacked relation. More particularly, this means includes a first pneumatic cylinder 150 fixed to the slide member 140 and mounted vertically. This cylinder 150 includes a piston 154 and the second cylinder 152 is fixedly attached to the lower end of this piston 154. The second cylinder 152 houses a piston 156 also supported for vertical reciprocal movement. The lower end of the piston 156 supports the extractor arm 44.

In operation of the exterior gripper 44, the cable cylinder 142 is actuated to cause the extractor gripper 44 to move forwardly from the position shown in FIG. 6 to a forward position wherein the lower end 130 of the extractor gripper 44 is adjacent the shed opening 36. The cylinders 150 and 152 are then actuated to cause downward movement of the extractor gripper 44 to a position wherein the notch 132 can receive the warp thread 24 as the interlace arm 40 pulls the warp thread 24 through the shed opening. The warp thread 24 is then clampingly engaged in the notch 132 by the piston 131. The cylinder 152 is then actuated to cause upward movement of the extractor gripper arm 44 to a position wherein the warp thread 24 held by the free end 130 of the extractor gripper 44 will be positioned slightly above the plane of the seam. The cable cylinder 142 is then actuated again to cause rearward translational movement of the extractor arm 44 thereby pulling the warp thread 24 rearwardly such that it is pulled against the seam face 46 and the free end of the warp thread 24 is pulled under the ski 154. The second cylinder 150 is then actuated to cause upward movement of the extractor arm 44 to the position which is shown in FIG. 6.

Means are also provided for beating the warp thread 24 against the seam face 46 in a manner which provides for alignment of the knuckles of the fabric. The means for beating the warp threads 24 against the seam face 46 is best shown in FIG. 7 and generally comprises a lay and reed mechanism 160 supported by the frame 50 and positioned below the woven seam 10 being formed. The lay and reed mechanism 160 includes a plurality of reed dents 162, the reed dents 162 being conventional and generally comprising thin elongated metal strips positioned in side by side stacked relation, the reed dents defining a plurality of closely spaced vertical paralled planes, and with one of the strips or reed dents 162 being positioned between each pair of weft threads 18. The lay and reed mechanism 160 also includes means for supporting the plurality of reed dents 162 such that they are moveable from the position shown in FIG. 7 in solid lines to the dotted line or phantom position.

More particularly, the means for supporting the reed dents 162 includes a support arm 164 which is pivotably joined at its lower end to the machine frame 50 for pivotal movement between the solid line position or retracted position shown in FIG. 7 and the phantom position wherein the reed dents 162 can beat the warp thread 24 into the seam face 46. Means are also provided for causing such reciprocal or pivotal movement of the support arm 164. In the illustrated construction, this means includes a pneumatic piston 166 pivotably connected by a pin 168 to the machine frame 50 and including a piston 170 pivotably connected to the support arm 164 by a pin 172 at a point intermediate the opposite ends of the support arm 164. The upper end of the support arm 164 includes a pivot shaft 174. The planar thin metal strips forming the reed dents 162 are mounted in side by side stacked relationship on this pivot shaft 174, and the reed dents 162 are supported on pivot shaft 174 to be freely pivotable about the axis of this pivot shaft 174 and are freely and independently moveable with respect to each other. One of the features of the invention is the provision of means, when the support arm is in the phantom position shown in FIG. 7, for causing engagement of successive ones of the reed dents 162 against the warp thread 24 to beat the warp thread against the seam face 46. This means provides for a wave action of the reed dents 162. This wave action propagating from one side of the seam to the other and in the direction of the free end of the warp thread being forced against the seam face. Stated alternatively, successive ones of the reed dents 162 from one side of the seam face to an opposite side of the seam face engage the warp thread and pound it against the seam face 46. When the pneumatic cylinder 166 causes the support arm 164 to pivot from the solid line position shown in FIG. 7 to the phantom line position, the reed dents 164 are moved to the dotted line position. Means are also provided for causing these reed dents 162 to move to the broken line position shown in FIG. 7 wherein these reed dents 162 will engage the warp thread and force it against the seam face 46. This means for causing the reed dents 162 to move from the dotted line position to the broken line position in FIG. 7 includes a reed roller 180 adapted to engage the lower ends 182 of the reed dents 162 as shown in FIG. 7. The reed roller 180 is supported for translational movement in the direction of the axis of the horizontal pivot shaft 174 of the reed dents 162 such that the roller 180 can move from one end of the pivot shaft 174 to the opposite end and contact successive ones of the reed dents 162 as it moves reciprocably in this manner. As the reed roller 180 moves along the length of the horizontal pivot shaft 174 it will contact successive ones of the reed dents causing them to pivot from the dotted line position shown in FIG. 7 to the broken line position.

Means are also provided for causing such translational movement of the reed roller 180 along the length of the horizontal pivot shaft 174. In the illustrated construction, the reed roller 180 is supported for rotation about the axis of a generally vertically extending shaft 186, the reed roller 180 being freely rotatably about this shaft. The lower end of the shaft 186 is supported by a slide member 188 supported for slideable reciprocable movement on a pair of support rods 190. The lower end of the slide member 188 is fixed to a cable 192 of a cable cylinder 194 having the same structure as the cable cylinder 142 supporting the extractor gripper arm 44. Operation of the cable cylinder 194 is functional to cause translational reciprocal movement of the slide member 188 and the reed roller 180 along the support shafts 190 and in the direction of the longitudinal axis of the pivot shaft 174 of the reed dents. While the slide member 188 has been described as being driven by a cable cylinder 194, it will be readily understood that in other embodiments of the invention, an elongated pneumatic piston and cylinder arrangement could be provided to cause such translational movement. Similarly, a screwdrive arrangement or other similar conventional device could also be employed.

In a preferred form of the invention, the frame 50 also includes an electric motor 51 operably drivingly connected to at least one wheel 52 supporting the frame 50 such that the seaming machine is mechanically driven along the length of the seam as the seam weaving process continues.

Means are also provided for sending a signal to the electric motor 51 to cause operation of the electric motor 51 and movement of the frame 50 as the seam weaving process continues and the seam face builds up. In a preferred form of the invention, the lay and reed mechanism 160 includes means for sending a signal to the electric drive motor 51 for causing the motor to cause a slight advance of the machine when the seam face 46 builds up. In the illustrated construction, this means for sending a signal to the motor includes an electrical switch 196 fixed to the support arm 164. In a preferred form of the invention, the reed dents 162 and the structure for causing pivotal movement of the reed dents about the horizontal pivot shaft 174 are all supported by a frame 198, the frame 198 being pivotably joined by a pivot pin 200 to the upper end of the support arm 164. The frame 198 is supported for limited pivotal movement with respect to the upper end of the support arm 164. The frame structure 198, the reed mechanism and the means for causing respective pivotal movement of the reed dents 162 are weighted such that when the support arm is in the position shown in phantom in FIG. 7, the weight of this structure tends to cause the reed dent supporting mechanism to pivot about the shaft in a clockwise direction as seen in FIG. 7. As the seam face 46 builds up, when the reed dents pivot from the dotted line position to the broken line position in FIG. 7, the seam face 46 will restrict the movement of the reed dents. When the seam face builds up sufficiently, when the reed dents are forced into engagement with the seam face, the frame 198 will pivot in a counterclockwise direction and will engage the switch 196 thereby sending a signal to the electric motor 51 to advance the seaming machine incrementally forwardly away from the seam face 46.

Means are also provided for controlling the operation of the pneumatic piston and cylinder assemblies described above and for supplying air pressure to these piston and cylinder assemblies so as to cause operation of the pneumatic cylinder assemblies in a controlled sequence. In a preferred form of the invention, the control means can be housed in the control housing 58 and can comprise a commercially available Martonaire Bi-Selector Model/660H manufactured by Martonaire, Ltd., Twickenham, England. As is conventional, this control apparatus can be operably connected by air lines to each of the pneumatically operated piston and cylinders through a series of control valves. The pneumatic sequencer operates to supply air to the pneumatic piston and cylinders in sequence to thereby provide for a step by step controlled and sequential operation of the various components.

In a prefered form of the invention, means are also provided for halting operation of the machine in the event any one of the piston and cylinder assemblies of the type shown in FIG. 12 fails to properly grip a thread. As described above, each gripper includes a piston and cylinder arrangement. The end of each such cylinder is provided with an electrical contact 210 (FIG. 12) and the piston also includes an electrical contact 212. When a thread is properly engaged by a gripper apparatus, the thread 24 will be positioned between the piston contact 212 and cylinder contact 210 thereby preventing electrical contact between the piston contact 212 and cylinder contact 210. If, on the other hand, the thread is not properly gripped, the end of the piston will make electrical contact with the cylinder contact 210 and the machine will be shut off. If desired, the electrical apparatus for shutting off the machine can also cause an alarm to be sounded. One of the features of the invention is that in the event the machine is shut off due to failure by one of the grippers to properly grip the warp thread 24, the operator can then cause the heddling sequence to reverse to a point where any flaw that has been created can be corrected.

Another of the advantages of the apparatus embodying the present invention is that the seam width can be adjustable from, for example, approximately 2 inches to approximately 6 inches depending on the type of fabric being seamed and the width of the seam desired. In a preferred form of the invention the downwardly extending support arms 70 are connected to the cantilevered frame 56 in a manner which permits adjustable movement of the arms toward and away from each other so as to permit adjustment of the positioning of the selector mechanisms and the warp thread transfer and weaving means. Accordingly, the width of the fabric strip positioned between the ends of the woven fabric can be of any desired width and the resulting seam can have any selected width.

Various features of the invention are set forth in the following claims.

We claim:

1. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising, means for causing the weft threads to form a shed opening, means for gripping successive ones of the warp threads of the fringe one at a time and for pulling these successive ones of the warp threads through the shed opening, said means for gripping the warp threads including a first arm having opposite ends, the first arm being supported for movement from a first position wherein one end of said first arm extends through said shed opening and a second position wherein said one end of said first arm is retracted from said shed opening, and said one end of said first arm including means for selectively gripping a warp thread, and means for transferring successive ones of the warp threads one at a time to said end of said first arm where said means for selectively gripping can grip the successive ones of the warp threads, said means for transferring successive ones of the warp threads including a transfer arm having opposite ends, one of said ends including means for selectively gripping a warp thread separated from the fringe, said transfer arm being supported for movement between a first position wherein said one of said ends of said transfer arm is adjacent the fringe and can grip a warp thread and a second position wherein said one of said ends of said transfer arm carries said warp thread to a position wherein said warp thread can be gripped by said one end of said first arm when said one end of said first arm extends through said shed opening, and means for separating successive ones of said warp threads from the fringe, said means for separating including means for moving said successive ones of said warp threads to said one of said ends of said transfer arm when said transfer arm is in said first position such that said one of said ends of said transfer arm can grip said successive ones of said warp threads.

2. The apparatus as set forth in claim 1 wherein said means for forming said shed opening includes a Jacquard machine.

3. Apparatus as set forth in claim 2 wherein said Jacquard machine includes a plurality of needles positioned below the weft threads and supported for vertical reciprocable movement, a spring box positioned above the weft threads, the spring box including a plurality of springs, and a plurality of heddles located between said needles and the spring box, the heddles being connected to said needles and to said springs of the spring box, the heddles being adapted to engage weft threads and to cause vertical movement of the weft threads to form the shed opening in response to movement of said needles.

4. Apparatus as set forth in claim 3 wherein said heddles can be slideably inserted over said weft threads such that the weft threads are housed in the heddles.

5. Apparatus as set forth in claim 1 wherein said means for separating successive ones of said ends of said warp threads includes a first moveable member having an end supported for reciprocal movement from a retracted position to a warp thread engaging position.

6. Apparatus as set forth in claim 5 wherein said fringe is supported in generally vertical relation and includes a plurality of warp threads positioned in side by side parallel relation, the warp threads being supported by at least one weft thread at the periphery of the fringe, and wherein the first moveable member is reciprocably moveable in a direction parallel to the weft thread.

7. Apparatus as set forth in claim 5 wherein said first moveable member includes means for gripping the first warp thread encountered as said first moveable member moves from a retracted position to a warp thread engaging position.

8. Apparatus as set forth in claim 7 wherein said means for separating successive ones of said warp threads further includes means for resiliently supporting said means for gripping the first warp thread encountered.

9. Apparatus as set forth in claim 1 wherein said one of said ends of said first arm is adapted to move through said shed opening from one side of said seam to grip a warp thread on an opposite side of said seam and adapted pull said warp thread through the shed opening to said one side of the seam, and wherein said means for gripping successive warp threads and for pulling them through said shed opening includes a second arm having opposite ends, one of said opposite ends of said second arm being adapted to move through a second shed opening from said opposite side of said seam to said one side of said seam wherein said one of said opposite ends of said second arm can engage a warp thread and being adapted to move through said second shed opening to pull said warp thread through said second shed opening.

10. Apparatus as set forth in claim 1 and further including means for forcing said warp thread pulled through said shed opening against the seam face, said means for forcing including a plurality of reed dents, said reed dents being supported in closely spaced relation, said reed dents being positioned between weft threads and separating the weft threads.

11. Apparatus as set forth in claim 10 wherein said means for forcing the weft thread against the seam face includes means for supporting said reed dents for movement from a first position spaced from the seam face to a second position adjacent the seam face but closely spaced from the seam face, and means for causing successive ones of said reed dents to move from said second position to a position wherein said warp thread is forced against said seam face.

12. Apparatus as set forth in claim 11 wherein said means for causing movement of individual ones of said reed dents causes movement of successive ones of said reed dents from one end of the seam face to the opposite end of the seam face.

13. Apparatus as set forth in claim 11 wherein said reed dents are supported for limited pivotal movement about an axis parallel to the seam face and for independent movement about said axis with respect to each other and wherein said means for causing successive ones of said reed dents to engage said warp thread includes a roller supported for movement along the seam face and for engaging the reed dents as the roller moves along the seam face and for causing the reed dents to force the warp thread against the seam face as the roller moves along the seam face.

14. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends of the fabric to thereby form a woven seam, the apparatus comprising, means for causing the weft threads to form a shed opening, means for gripping successive ones of the warp threads of the fringe and for separating the successive ones of the warp threads from the fringe, said means for gripping and separating including a first moveable member having an end adapted to be reciprocably moveable from a retracted position to a warp thread engaging position, means for pulling successive ones of the warp threads separated from the fringe through the shed opening, said means for pulling including means for gripping said successive ones of the warp threads, and means for transferring the successive ones of the warp threads separated from the fringe from the means for gripping and separating to the means for pulling the successive warp threads through the shed opening, the means for transferring including a transfer arm, said transfer arm having opposite ends, one of said ends of said transfer arm including means for gripping a warp thread separated from the fringe by the first moveable member, said transfer arm being supported for movement between a first position wherein said one of said ends is adjacent said first moveable member and a second position wherein said one of said ends of said transfer arm carries said warp thread to a second position wherein said means for pulling successive ones of the warp threads can grip said warp thread.

15. Apparatus as set forth in claim 14 wherein said fringe is supported in generally vertical relation and includes a plurality of warp threads positioned in side by side parallel relation, the warp threads being supported by at least one weft thread at the periphery of the fringe, and wherein the first moveable member is reciprocably moveable in a direction parallel to the weft thread.

16. Apparatus as set forth in claim 15 wherein said first moveable member includes means for gripping the first warp thread encountered as said first moveable member moves from a retracted position to a warp thread engaging position.

17. Apparatus as set forth in claim 16 and further including means for resiliently supporting said means for gripping the first warp thread encountered.

18. The apparatus as set forth in claim 14 wherein said means for forming said shed opening includes a Jacquard machine.

19. Apparatus as set forth in claim 18 wherein said Jacquard machine includes a plurality of needles positioned below the weft threads and supported for vertical reciprocable movement, a spring box positioned above the weft threads, said spring box including a plurality of springs, and a plurality of heddles located between said needles and said spring box, said heddles being connected to said needles and to said springs of said spring box, said heddles being adapted to engage the weft threads and to cause vertical movement of the weft threads to form the shed opening in response to movement of said needles.

20. Apparatus as set forth in claim 19 wherein said heddles can be slideably inserted over said weft threads such that the weft threads are housed in the heddles.

21. Apparatus as set forth in claim 14 wherein said means for gripping successive warp threads and for pulling them through the shed opening includes a first arm having opposite ends, one of said ends adapted to move through a first shed opening from one side of the seam to grip a warp thread on an opposite side of seam and to pull the warp thread through the first shed opening to said one side of the seam, and a second arm having opposite ends, one of said opposite ends of said second arm being adapted to move through a second shed opening from said opposite side of said seam to said one side of said seam wherein said one of said opposite ends of said second arm can engage a warp thread and then move through the second shed opening to pull said warp thread through the shed opening.

22. Apparatus as set forth in claim 14 and further including means for forcing said warp thread pulled through said shed opening against the seam face, said means for forcing including a plurality of reed dents, said reed dents being supported in closely spaced relation, said reed dents being positioned between weft threads and separating the weft threads.

23. Apparatus as set forth in claim 22 wherein said means for forcing the warp thread against the seam face includes means for supporting said reed dents for movement from a first position spaced from the seam face to a second position adjacent the seam face but closely spaced from the seam face, and means for causing successive ones of said reed dents to move from said second position to a position wherein said warp thread is forced against said seam face.

24. Apparatus as set forth in claim 23 wherein said reed dents are supported for limited pivotal movement about an axis parallel to the seam face and for independent movement about said axis with respect to each other and wherein said means for causing successive ones of said reed dents to engage said warp thread includes a roller supported for movement along the seam face and for engaging the reed dents as the roller moves along the seam face and for causing the reed dents to force the warp thread against the seam face as the roller moves along the seam face.

25. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising:

means for causing the weft threads to form a first shed opening, means for gripping a first one of said warp threads from the fringe of one of said ends of the fabric and for separating said first one of said warp threads from the fringe, means for pulling said first one of said warp threads through the first shed opening, said means for pulling including a first arm having opposite ends, the first arm being supported for movement from a first position wherein one end of said first arm extends through said first shed opening and a second position wherein said one end of said arm is pulled through said first shed opening, said end of said arm including means for selectively gripping a warp thread, means for transferring said first one of the warp threads separated from the fringe from the means for gripping and separating to the means for pulling the successive warp threads the means for transferring including a transfer arm, said transfer arm having opposite ends, one of said ends of said transfer arm including means for gripping a warp thread separated from the fringe by the means for gripping, said transfer arm being supported for movement between a first position wherein said one of said ends is adjacent said means for separating and a second position wherein said one of said ends of said transfer arm carries said warp thread to a second position wherein said means for pulling these warp threads can grip said warp thread, means for forcing said first one of said warp threads against the seam, means for causing the weft threads to form a second shed opening, means for separating a second warp thread from the fringe of the other of said ends of the fabric, and means for gripping said second warp thread and for pulling said second warp thread through the second shed opening, said means for gripping said second warp thread including a second arm having opposite ends.

26. The apparatus as set forth in claim 25 wherein said means for causing said weft threads to form said shed opening includes a Jacquard machine.

27. Apparatus as set forth in claim 26 wherein said Jacquard machine includes a plurality of needles positioned below the weft threads and supported for vertical reciprocable movement, a spring box positioned above the weft threads, said spring box including a plurality of springs, and a plurality of heddles located between said needles and said spring box, said heddles being connected to said needles and to said springs of said spring box, said heddles being adapted to engage the weft threads and to cause vertical movement of the weft threads to form the shed openings in response to movement of said needles.

28. Apparatus as set forth in claim 27 wherein said heddles can be slideably inserted over the weft threads such that the weft threads are housed in said heddles.

29. Apparatus as set forth in claim 25 and further including means for transferring said ends of said warp threads from said means for separating said first warp thread from the fringe to said one end of said first arm when said one end of said first arm extends through said shed opening, said means for transferring including a pivotable transfer arm.

30. Apparatus as set forth in claim 29 and wherein said transfer arm includes opposite ends, one of said ends including means for gripping a warp thread separated from said fringe by said means for separating said transfer arm being supported for pivotable movement between a first position wherein said one of said ends is adjacent said means for separating wherein said transfer arm means for gripping can engage a warp thread and a second position wherein said one of said ends of said transfer arm carries said warp thread to said one end of said first arm.

31. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising means for causing the weft threads to form a shed opening, means for gripping successive ones of the warp threads of the fringe and for pulling these warp threads through the shed opening, said means for gripping the warp threads including a first arm having opposite ends, the first arm being supported for movement from a first position wherein one end of said first arm extends through said shed opening and a second position wherein said one end of said arm is retracted from said shed opening, and one end of said arm including means for selectively gripping a warp thread, and means for forcing said warp thread pulled through said shed opening against the seam face, said means for forcing including a plurality of reed dents, said reed dents being supported in closely spaced relation, said reed dents being positioned between weft threads and separating the weft threads, and means for supporting said reed dents for movement from a first position spaced from the seam face to a second position adjacent the seam face but closely spaced from the seam face, and means for causing successive ones of said reed dents to move from said second position to a position wherein said warp thread is forced against said seam face.

32. Apparatus as set forth in claim 31 wherein said means for causing movement of individual ones of said reed dents causes movement of successive ones of said reed dents from one end of the seam face to the opposite end of the seam face.

33. Apparatus as set forth in claim 31 wherein said reed dents are supported for limited pivotal movement about an axis parallel to the seam face and for independent movement about said axis with respect to each other and wherein said means for causing successive ones of said reed dents to engage said warp thread includes a roller supported for movement along the seam face and for engaging the reed dents as the roller moves along the seam face and for causing the reed dents to force the warp thread against the seam face as the roller moves along the seam face.

34. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising means for causing the weft threads to form a shed opening, means for gripping successive ones of the warp threads of the fringe and for pulling these warp threads through the shed opening, said means for gripping the warp threads including a first arm having opposite ends, the first arm being supported for movement from a first position wherein one end of said first arm extends through said shed opening and a second position wherein said one end of said arm is retracted from said shed opening, and one end of said arm including means for selectively gripping a warp thread, and means for forcing said warp thread pulled through said shed opening against the seam face, said means for forcing including a plurality of reed dents, said reed dents being supported in closely spaced relation, said reed dents being positioned between weft threads and separating the weft threads, means for supporting said reed dents for movement from a first position spaced from said seam face to a second position adjacent the seam face but closely spaced from the seam face, and means for causing successive ones of said reed dents to move from said second position to a position wherein said warp thread is forced against said seam face, and said reed dents being supported for limited pivotal movement about an axis parallel to the seam face and for independent movement about said axis with respect to each other, and said means for causing successive ones of said reed dents to engage said warp thread including a roller supported for movement along the seam face and for engaging the reed dents as the roller moves along the seam face and for causing the reed dents to force the warp thread against the seam face as the roller moves along the seam face.

35. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising, means for causing the weft threads to form a shed opening, means for gripping successive ones of the warp threads of the fringe and for separating the successive ones of the warp threads from the fringe, said means for gripping and separating including a first moveable member having an end adapted to be reciprocably moveable from a retracted position to a warp thread engaging position, means for gripping successive ones of the warp threads separated from the fringe and for pulling these warp threads through the shed opening, and means for forcing a warp thread pulled through said shed opening against the seam face, said means for forcing including a plurality of reed dents, said reed dents being supported in closely spaced relation, said reed dents being positioned between weft threads and separating the weft threads, said means for forcing a warp thread against the seam face further including means for supporting said reed dents for movement from a first position spaced from the seam face to a second position adjacent the seam face but closely spaced from the seam face, and means for causing successive ones of said reed dents to move from said second position to a position wherein said warp thread is forced against said seam face, and said reed dents being supported for limited pivotal movement about an axis parallel to the seam face and for independent movement about said axis with respect to each other and wherein said means for causing successive ones of said reed dents to engage said warp thread includes a roller supported for movement along the seam face and for engaging the reed dents as the roller moves along the seam face and for causing the reed dents to force the warp thread against the seam face as the roller moves along the seam face.

36. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising means for causing the weft threads to form a first shed opening, means for gripping a first one of said warp threads from the fringe of one of said ends of the fabric and for separating said first one of said warp threads from the fringe, means for gripping said first one of the warp threads and for pulling said first one of the warp threads through the first shed opening, said means for gripping said first one of the warp threads including a first arm having opposite ends, the first arm being supported for movement from a first position wherein one end of said first arm extends through said first shed opening and a second position wherein said one end of said arm is pulled through said first shed opening, said end of said arm including means for selectively gripping a warp thread, means for forcing said first one of said warp threads against the seam, means for causing the weft threads to form a second shed opening, means for separating a second warp thread from the fringe of the other of said ends of the fabric, and means for gripping said second warp thread and for pulling said second warp thread through the second shed opening, said means for gripping said second warp thread including a second arm having opposite ends, said means for causing said weft threads to form said shed opening including a Jacquard machine having a plurality of needles positioned below the weft threads and supported for vertical reciprocable movement, a spring box positioned above the weft threads, said spring box including a plurality of springs, and a plurality of heddles located between said needles and said spring box, said heddles being connected to said needles and to said springs of said spring box, said heddles being adapted to engage the weft threads and to cause vertical movement of the weft threads to form the shed openings in response to movement of said needles, and said heddles being slideably inserted over the weft threads such that the weft threads are housed in said heddles.

37. In an apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, an apparatus comprising:

means for separating successive ones of the warp threads from the fringe, said means for separating including means for moving the successive ones of the warp threads to a position where they may be gripped and interweaved with the weft threads, said means for separating including a first moveable member supported for reciprocal movement in the direction of the strip of weft threads between a retracted position and a position wherein said first moveable member can engage a first warp thread of the fringe, and means carried by said first moveable members for selectively clampingly engaging the first warp thread when said first moveable member moves to said position wherein said first moveable member can engage a first warp thread of the fringe and for releasing the first warp thread when the first moveable member moves to said retracted position.

38. A method for forming a woven seam in a length of woven fabric having opposite ends to join together the opposite ends of the fabric and to thereby form an endless woven fabric belt, the method comprising the steps of:

supporting a strip of weft threads in parallel relation, supporting the opposite ends of the length of fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends of the fabric to thereby form a woven seam, causing the weft threads to form a shed opening, gripping successive ones of the warp threads of the fringe and separating the successive ones of the warp threads from the fringe, said step of gripping and separating including reciprocably moving a first moveable member having an end from a retracted position to a warp thread engaging position, transferring the successive ones of the warp threads separated from the fringe to a means for pulling the successive warp threads through the shed opening, the step of transferring including the step of moving a transfer arm between a first position wherein one end of the transfer arm is adjacent the first moveable member and wherein the transfer arm can grip a warp thread separated from the fringe by the first moveable member and a second position wherein said one end of said transfer arm carries the warp thread to a second position wherein the means for pulling the successive warp threads can grip the warp thread, and pulling the warp threads separated from the fringe through the shed opening, said step of pulling including gripping said warp threads.

39. A method for forming a seam in a length of woven fabric having opposite ends to join together the opposite ends of the fabric to thereby form an endless woven fabric belt, the method comprising the steps of:

supporting a strip of weft threads in parallel relation, supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, causing the weft threads to form a first shed opening, gripping a first one of the warp threads from the fringe of one of the ends of the fabric and separating the first one of said warp threads from the fringe, transferring said first one of the warp threads separated from the fringe to a means for pulling the successive warp threads through the first shed opening, the step of transferring including moving a transfer arm, having an end including means for gripping a warp thread separated from the fringe, between a first position wherein the end is adjacent the first warp thread separated from the fringe and a second position wherein the end of the transfer arm carries the warp thread to a second position wherein the warp thread can be pulled through the shed opening, pulling the first one of the warp threads through the first shed opening, said step of pulling including moving a first arm having an end including means for selectively gripping a warp thread from a first position wherein the end of the first arm extends through the first shed opening and a second position wherein the end of the first arm is pulled through the first shed opening, forcing said first one of said warp threads against the seam, causing the weft threads to form a second shed opening, gripping and separating a second warp thread from the fringe of the other of said ends of the fabric, transferring said second warp thread to a means for pulling the second warp thread through the second shed opening, gripping said second warp thread and pulling said second warp thread through the second shed opening, and forcing said second warp thread against the seam.

40. A method for forming a seam in a length of woven fabric having opposite ends to join together the opposite ends of the fabric to thereby form an endless woven fabric belt, the method comprising the steps of supporting a strip of weft threads in parallel relation, supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, causing the weft threads to form a shed opening, gripping successive ones of the warp threads of the fringe and pulling these warp threads through the shed opening, the step of gripping and pulling the warp threads including moving a first arm between a first position wherein one end of said first arm extends through the shed opening and a second position wherein the one end of the first arm is retracted from the shed opening, and one end of the arm including means for selectively gripping a warp thread, and forcing the warp thread pulled through the shed opening against the seam face, the step of forcing the warp thread against the seam face including causing a plurality of reed dents, supported in closely spaced relation and being positioned between weft threads and separating the weft threads, to move from a first position spaced from the seam face to a second position adjacent the seam face but closely spaced from the seam face, and subsequently to move from said second position to a position wherein said warp thread is forced against said seam face.

41. A method as set forth in claim 40 wherein said reed dents are supported for limited pivotal movement about an axis parallel to the seam face and for independent movement about said axis with respect to each other and wherein successive ones of said reed dents are caused to engage said warp thread as a roller supported for movement along the seam face engages the reed dents and moves along the seam face and causes the reed dents to force the warp thread against the seam face.

* * * * *

UNITED STATES PATENT AND TRADEMARK OFFICE

CERTIFICATE OF CORRECTION

PATENT NO. : B1 4,581,794

DATED : January 3, 1989

INVENTOR(S) : Malcolm Oldroyd et al.

It is certified that error appears in the above-identified patent and that said Letters Patent is hereby corrected as shown below:

At column 3, line 14, the word "the" should be -said--.

At column 3, line 50, after the word "from" insert -the--.

At column 3, line 51, after the word "one" insert -end--.

At column 4, line 32, the word "aroller" should be -a roller--.

At column 6, line 47, the word "supportinga" hould be --supporting a--.

At column 6, line 64, the hyphen should be deleted fter the word "said" third occurrence.

At column 7, line 10, the word "postion" should be -position--.

At column 7, line 31, the words "the fringe" ıould be deleted.

UNITED STATES PATENT AND TRADEMARK OFFICE

CERTIFICATE OF CORRECTION

PATENT NO. : B1 4,581,794

DATED : January 3, 1989

INVENTOR(S) : Malcolm Oldroyd et al

It is certified that error appears in the above-identified patent and that said Letters Patent is hereby corrected as shown below:

At column 7, line 31, a new paragraph should start beginning with the word "means".

Signed and Sealed this

Eighteenth Day of July, 1989

*Attest:*

*Attesting Officer*

DONALD J. QUIGG

*Commissioner of Patents and Trademarks*

REEXAMINATION CERTIFICATE (985th)

United States Patent [19]

Oldroyd et al.

[11] B1 4,581,794

[45] Certificate Issued Jan. 3, 1989

[54] AUTOMATIC SEAMING MACHINE FOR FABRIC BELTS

[75] Inventors: Malcolm Oldroyd, Appleton; Dominique G. Rateau, Weyauwega; Merlin A. Luebke; Larry D. Anderson, both of Appleton, all of Wis.

[73] Assignee: Asten Group Inc., Devon, Pa.

Reexamination Request:
No. 90/001,503, Apr. 29, 1988

Reexamination Certificate for:

| | |
|---|---|
| Patent No.: | **4,581,794** |
| Issued: | **Apr. 15, 1986** |
| Appl. No.: | **770,352** |
| Filed: | **Aug. 27, 1985** |

Related U.S. Application Data

[63] Continuation of Ser. No. 587,045, Mar. 7, 1984, abandoned.

[51] Int. Cl.[4] ..... D03J 1/14

[52] U.S. Cl. ..... 28/141

[58] Field of Search ..... 139/1 R, 11 R, 28, 188 R, 139/190, 93; 28/241

[56] References Cited

U.S. PATENT DOCUMENTS

| | | |
|---|---|---|
| 880,215 | 2/1908 | Hiller . |
| 1,079,470 | 11/1913 | Colman . |
| 1,082,474 | 12/1913 | Colman . |
| 1,245,418 | 11/1917 | Alford . |
| 1,341,244 | 5/1920 | Ruegg . |
| 1,341,245 | 5/1920 | Ruegg, Jr. . |
| 1,779,312 | 10/1930 | Hammer . |
| 2,011,115 | 8/1935 | Peterson . |
| 2,039,157 | 4/1936 | Fleischer . |
| 2,385,703 | 9/1945 | Heiber . |
| 2,449,691 | 9/1948 | Deal . |
| 2,523,932 | 9/1950 | Abbott . |
| 2,786,256 | 3/1957 | Axelsson . |
| 2,800,927 | 7/1957 | Silberman et al. . |
| 2,845,686 | 8/1958 | Mason . |
| 2,863,492 | 12/1958 | Chang et al. . |
| 2,883,734 | 4/1959 | Draper, Jr. . |
| 2,907,093 | 10/1959 | Draper, Jr. . |
| 3,060,547 | 10/1962 | MacBean . |
| 3,110,078 | 11/1963 | Eriksson . |
| 3,238,594 | 3/1966 | Schuster . |
| 3,283,388 | 11/1966 | Kelleher et al. . |
| 3,436,041 | 4/1969 | Haller . |
| 3,622,415 | 11/1971 | Kunsman . |
| 3,885,596 | 5/1975 | Alexeff . |
| 3,962,762 | 6/1976 | Alexeff . |
| 3,974,551 | 8/1976 | Baer et al. . |
| 3,990,732 | 11/1976 | Reichert . |
| 4,006,760 | 2/1977 | Romanski et al. . |
| 4,026,331 | 5/1977 | Lees et al. . |
| 4,083,090 | 4/1978 | Duvekot . |
| 4,095,622 | 6/1978 | MacBean . |
| 4,144,911 | 3/1979 | Veith . |
| 4,152,815 | 5/1979 | Altenweger . |
| 4,175,307 | 11/1979 | Altenweger . |
| 4,194,538 | 3/1980 | Borodin et al. . |
| 4,206,787 | 6/1980 | Strandly . |
| 4,244,084 | 1/1981 | Gisbourne . |
| 4,267,226 | 5/1981 | Kohler et al. . |
| 4,286,631 | 9/1981 | Strandly . |
| 4,311,172 | 1/1982 | Eckstein . |
| 4,410,015 | 10/1983 | Koller et al. . |

FOREIGN PATENT DOCUMENTS

| | | |
|---|---|---|
| 0013994 | 8/1980 | European Pat. Off. . |
| 0043441 | 1/1982 | European Pat. Off. . |
| 8122448 | 1/1983 | Fed. Rep. of Germany . |
| 8122450 | 1/1983 | Fed. Rep. of Germany . |
| 8122451 | 1/1983 | Fed. Rep. of Germany . |
| 952973 | 5/1949 | France . |

OTHER PUBLICATIONS

Publication by Samuel Dracup and Sons Ltd., Lane Close Mills, Great Horton.

*Primary Examiner*—Henry Jaudon

[57] ABSTRACT

A machine for forming a seam in a length of woven fabric to join together opposite ends of the gavric to thereby form an endless woven fabric belt.

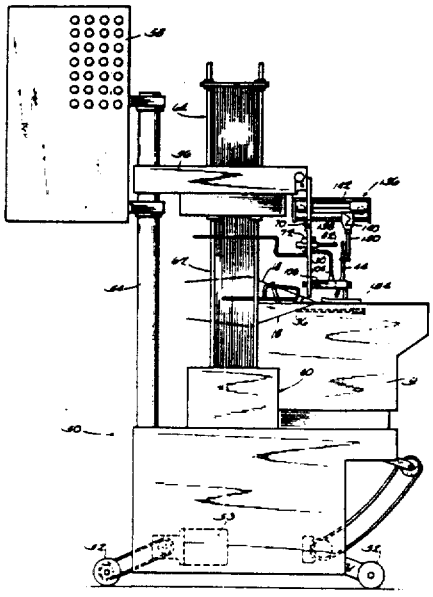

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printing in italics indicates additions made to the patent.

AS A RESULT OF REEXAMINATION, IT HAS BEEN DETERMINED THAT:

The patentability of claims 14–24, 31–33, 36 and 38–41 is confirmed.

Claims 5, 26 and 27 are cancelled.

Claims 1, 2, 6, 7, 9, 10, 25, 28, 29, 34, 35 and 37 are determined to be patentable as amended.

Claims 3, 4, 8, 11–13, and 30, dependent on an amended claim, are determined to be patentable.

New claims 42–46 are added and determined to be patentable.

1. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising, means for causing the weft threads to form a shed opening, means for gripping successive ones of the warp threads of the fringe one at a time and for pulling these successive ones of the warp threads through the shed opening, said means for gripping the warp threads including a first arm having opposite ends, the first arm being supported for movement from a first position wherein one end of said first arm extends through said shed opening and a second position wherein said one end of said first arm is retracted from said shed opening, and said one end of said first arm including means for selectively gripping a warp thread, and means for transferring successive ones of the warp threads one at a time to said end of said first arm where said means for selectively gripping can grip the successive ones of the warp threads, said means for transferring successive ones of the warp threads including a transfer arm having opposite ends, one of said ends including means for selectively gripping a warp thread separated from the fringe, said transfer arm being supported for movement between a first position wherein said one of said ends of said transfer arm is adjacent the fringe and can grip a warp thread and a second position wherein said one of said ends of said transfer arm carries said warp thread to a position wherein said warp thread can be gripped by said one end of said first arm when said one end of said first arm extends through said shed opening, and means for separating successive ones of said warp threads from the fringe, said means for separating *being mounted for reciprocal horizontal movement toward and away from said fringe and* including means for moving said successive ones of said warp threads to said one of said ends of said transfer arm when said transfer arm is in said first position such that said one of said ends of said transfer arm can grip said successive ones of said warp threads.

2. The apparatus as set forth in claim [1] *42* wherein said means for forming said shed opening includes a Jacquard machine.

6. Apparatus as set forth in claim [5] *42* wherein said fringe is supported in generally vertical relation and includes a plurality of warp threads positioned in side by side parallel relation, the warp threads being supported by at least one weft thread at the periphery of the fringe, and wherein the first moveable member is reciprocably moveable in a direction parallel to the weft thread.

7. Apparatus as set forth in claim [5] *42* wherein said first moveable member includes means for gripping the first warp thread encountered as said first moveable member moves from a retracted position to a warp thread engaging position.

9. Apparatus as set forth in claim [1] *42* wherein said one of said ends of said first arm is adapted to move through said shed opening from one side of said seam to grip a warp thread on an opposite side of said seam and adapted pull said warp thread through the shed opening to said one side of the seam, and wherein said means for gripping successive warp threads and for pulling them through said shed opening includes a second arm having opposite ends, one of said opposite ends of said second arm being adapted to move through a second shed opening from said opposite side of said seam to said one side of said seam wherein said one of said opposite ends of said second arm can engage a warp thread and being adapted to move through said second shed opening to pull said warp thread through said second shed opening.

10. Apparatus as set forth in claim [1] *42* and further including means for forcing said warp thread pulled through said shed opening against the seam face, said means for forcing including a plurality of reed dents, said reed dents being supported in closely spaced relation, said reed dents being positioned between weft threads and separating the weft threads.

25. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising:

means for causing the weft threads to form a first shed opening, means for gripping a first one of said warp threads from the fringe of one of said ends of the fabric and for separating said first one of said warp threads from the fringe, *said means supported for reciprocal movement from a retracted position to a warp thread engagement position,* means for pulling said first one of said warp threads through the first shed opening, said means for pulling including a first arm having opposite ends, the first arm being supported for movement from a first position wherein one end of said first arm extends through said first shed opening and a second position wherein said one end of said arm is pulled through the first shed opening, said end of said arm including means for selectively gripping a warp thread, means for transferring said first one of the warp threads separated from the fringe from the means for gripping and separating to the means for pulling the successive warp threads the means for transferring including a transfer arm, said transfer arm having opposite ends, one of said ends of said transfer arm including means for gripping a warp thread separated from the fringe by the means for gripping, said transfer arm being supported for movement between a first position wherein said one of said ends is adjacent said means for separating and a second position wherein said one of said ends of said transfer arm carries said warp thread to a second position wherein said means for pulling these warp threads can grip said warp thread, means for forcing said first one of said warp threads against the seam, means for causing the weft threads to form a second shed opening, means for separating a second warp thread from the fringe of the other of said ends of the fabric, and means for gripping said second warp thread and for pulling said second warp thread through the second shed opening, said means for gripping said second warp thread including a second arm having opposite ends.

28. Apparatus as set forth in claim [27] *43* wherein said heddles can be slideably inserted over the weft threads such that the weft threads are housed in said heddles.

29. Apparatus as set forth in claim [25] *43* and further including means for transferring said ends of said warp threads from said means for separating said first warp thread from fringe to said one end of said first arm when said one of said first arm extends through said shed opening, said means for transferring including a pivotable transfer arm.

34. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising means for causing the weft threads to form a shed opening, means for gripping successive ones of the warp threads of the fringe and for pulling these warp threads through the shed opening, said means for gripping the warp threads including a first arm having opposite ends, the first arm being supported for movement from a first position wherein one end of said first arm extends through said shed opening and a second position wherein said one end of said arm is retracted from said shed opening, and one end of said arm including means for selectively gripping a warp thread, and means for forcing said warp thread pulled through said shed opening against the seam face, said means for forcing including *an extractor means for selectively gripping a warp thread, and* a plurality of reed dents, said reed dents being supported in closely spaced relation, said reed dents being positioned between weft threads and separating the weft threads, means for supporting said reed dents for movement from a first position spaced from said seam face to a second position adjacent the seam face but closely spaced from the seam face, and means for causing successive ones of said reed dents to move from said second position to a position wherein said warp thread is forced against said seam face, and said reed dents being supported for limited pivotal movement about an axis parallel to the seam face and for independent movement about said axis with respect to each other, and said means for causing successive ones of said reed dents to engage said warp thread including aroller supported for movement along the seam face and for engaging the reed dents as the roller moves along the seam face and for causing the reed dents to force the warp thread against the seam face as the roller moves along the seam face.

35. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising, means for causing the weft threads to form a shed opening, means for gripping successive ones of the warp threads of the fringe and for separating the successive ones of the warp threads from the fringe, said means for gripping and separating including a first moveable member having an end adapted to be reciprocably moveable from a retracted position to a warp thread engaging position, means for gripping successive ones of the warp threads separated from the fringe and for pulling these warp threads through the shed opening, *said means further including a transfer means and an interlace means,* and means for forcing a warp thread pulled through said shed opening against the seam face, said means for forcing including a plurality of reed dents, said reed dents being supported in closely spaced relation, said reed dents being positioned between weft threads and separating the weft threads, said means for forcing a warp thread against the seam face further including means for supporting said reed dents for movement from a first position spaced from the seam face to a second position adjacent the seam face but closely spaced from the seam face, and means for causing successive ones of said reed dents to move from said second position to a position wherein said warp thread is forced against said seam face, and said reed dents being supported for limited pivotal movement about an axis parallel to the seam face and for independent movement about said axis with respect to each other and wherein said means for causing successive ones of said reed dents to engage said warp thread includes a roller supported for movement along the seam face and for engaging the reed dents as the roller moves along the seam face and for causing the reed dents to force the warp thread against the seam face as the roller moves along the seam face.

37. In an apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, an apparatus comprising:

means for separating successive ones of the warp threads from the fringe, said means for separating including means for moving the successive ones of the warp threads to a position where they may be gripped and interweaved with the weft threads, said means for separating including a first moveable member supported for reciprocal movement in the direction of the strip of weft threads between a retracted position and a position wherein said first moveable member can engage a first warp thread of the fringe, and means carried by said first moveable members for selectively clampingly engaging the first warp thread when said first moveable member moves to said position wherein said first moveable member can engage a first warp thread of the fringe and for releasing the first warp thread when the first moveable member moves to said retracted position, *and transfer means for transferring said first warp thread from said moveable member to said position where it is gripped and interweaved with the weft threads.*

*42. Apparatus for forming a seam in a length of woven fabric having opposite ends to join together the opposite ends of the fabric by means of a woven seam and to thereby form an endless woven fabric belt, and for use with means for supporting a strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising,*

*means for causing the weft threads to form a shed opening,*

*means for gripping successive ones of the warp threads of the fringe one at a time and for pulling these successive ones of the warp threads through the shed opening, said means for gripping the warp threads including a first arm having opposite ends, the first arm being supported for movement from a first position wherein one end of said first arm extends through said shed opening and a second position wherein said one end of said first arm is retracted from said shed opening, and said one end of said first arm including means for selectively gripping a warp thread, and*

*means for transferring successive ones of the warp threads one at a time to said end of said first arm where said means for selectively gripping can grip the successive ones of the warp threads, said means for transferring successive ones of the warp threads including a transfer arm having opposite ends, one of said ends including means for selectively gripping a warp thread separated from the fringe, said transfer arm being supported for movement between a first position wherein said one of said ends of said transfer arm is adjacent the fringe and can grip a warp thread and a second position wherein said one of said ends of said transfer arm carries said warp thread to a position wherein said warp thread can be gripped by said one end of said first arm when said one end of said first arm extends through said shed opening, and*

*means for separating successive ones of said warp threads from the fringe, said means for separating including a first moveable member having an end supported for reciprocal movement from a retracted position to a warp thread engaging position for moving said successive ones of said warp threads to said one of said ends of said transfer arm when said transfer arm is in said first position such that said one of said ends of said transfer arm can grip said successive ones of said warp threads.*

*43. Apparatus for forming a seam in a length of woven fabric having opposite ends to join together the opposite ends of the fabric by means of a woven seam and to thereby form an endless woven fabric belt, and for use with means for supportinga strip of weft threads in parallel relation and for supporting the opposite ends of the fabric in closely spaced relation on opposite sides of the strip of weft threads, the opposite ends of the fabric each including a fringe of warp threads, the warp threads of the opposite ends of the woven fabric being supported such that they can be interweaved with the weft threads supported between the opposite ends to thereby form a woven seam, the apparatus comprising:*

*Jacquard machine means for causing the weft threads to form a first shed opening, wherein said Jacquard machine includes a plurality of needles positioned below the weft threads and supported for vertical reciprocable movement, a spring box positioned above the weft threads, said spring box including a plurality of springs, and a plurality of heddles located between said needles and said spring box, said heddles being connected to said needles and to said springs of said spring box, said heddles being adapted to engage the weft threads and to cause vertical movement of the weft threads to form the shed openings in response to movement of said needles,*

*means for gripping a first one of said warp threads from the fringe of one of said ends of the fabric and for separating said first one of said warp threads from the fringe,*

*means for pulling said first one of said warp threads through the first shed opening, said means for pulling including a first arm having opposite ends, the first arm being supported for movement from a first position wherein one end of said first arm extends through said first shed opening and a second postion wherein said one end of said arm is pulled through said first shed opening, said end of said arm including means for selectively gripping a warp thread,*

*means for transferring said first one of the warp threads separated from the fringe from the means for gripping and separating to the means for pulling the successive warp threads the means for transferring including a transfer arm, said transfer arm having opposite ends, one of said ends of said transfer arm including means for gripping a warp thread separated from the fringe by the means for gripping, said transfer arm being supported for movement between a first position wherein said one of said ends is adjacent said means for separating and a second position wherein said one of said ends of said transfer arm carries said warp thread to a second position wherein said means for pulling these warp threads can grip said warp thread,*

*means for forcing said first one of said warp threads against the seam,*

*means for causing the weft threads to form a second shed opening; the fringe means for separating a second warp thread from the fringe of the other of said ends of the fabric, and*

*means for gripping said second warp thread and for pulling said second warp thread through the second shed opening, said means for gripping said second warp thread including a second arm having opposite ends.*

*44. Apparatus for forming a seam in a length of woven fabric having opposite ends to join together the opposite ends of the fabric by means of a woven seam and to thereby form an endless woven fabric belt, the opposite ends of the fabric each including a fringe of warp threads, the warp threads of the opposite ends of the woven fabric being supported such that they can be interweaved with the weft threads supported between the opposite ends of the fabric to thereby form a woven seam, the apparatus comprising,*

*means for causing the weft threads to form a shed opening,*

*means for gripping successive ones of the warp threads of the fringe and for separating the successive ones of the warp threads from the fringe, said means for gripping and separating including a first moveable member having an end adapted to be reciprocably moveable from a retracted position to a warp thread engaging position,*

*means for pulling successive ones of the warp threads separated from the fringe through the shed opening, said means for pulling including means for gripping said successive ones of the warp threads, and*

*means for transferring the successive ones of the warp threads separated from the fringe from the means for gripping and separating to the means for pulling the successive warp threads through the shed opening, and*

*means for extracting successive ones of the warp thread beyond the shed opening and against the seam face.*

*45. The apparatus of claim 31 wherein the first arm of said means for gripping successive ones of the warp threads of the flange is supported for pivotal movement between the said first and second positions.*

*46. The apparatus of claim 31 wherein the means for forcing said warp thread pulled through said shed opening against the seam face further includes an extractor means for selectively gripping said warp thread after it is pulled through said shed.*

* * * * *